US006675614B2

(12) United States Patent
Lai

(10) Patent No.: US 6,675,614 B2
(45) Date of Patent: Jan. 13, 2004

(54) HIGH SECURITY COMBINATION PADLOCK WITH LOCKING BAR

(75) Inventor: Eric Lai, Sheung Shui (HK)

(73) Assignee: The Sun Lock Company, Ltd., Hong Kong (HK)

( * ) Notice: Subject to any disclaimer, the term of this patent is extended or adjusted under 35 U.S.C. 154(b) by 0 days.

(21) Appl. No.: 10/076,775

(22) Filed: Feb. 13, 2002

(65) Prior Publication Data

US 2003/0150245 A1 Aug. 14, 2003

(51) Int. Cl.[7] ..... E05B 37/06; E05B 37/10

(52) U.S. Cl. ..... 70/25; 70/22; 70/312; 70/315

(58) Field of Search ..... 70/25, 22, 312, 70/233, 23, 24, 26, 28, 315–317, 324, 32–34

(56) References Cited

U.S. PATENT DOCUMENTS

| | | | | | |
|---|---|---|---|---|---|
| 1,823,650 | A | * | 9/1931 | Gordon | 70/25 |
| 2,104,981 | A | | 1/1938 | Falk | 70/33 |
| 4,183,235 | A | | 1/1980 | Coralli et al. | 70/34 |
| 4,195,502 | A | * | 4/1980 | Best et al. | 70/224 |
| 5,005,384 | A | * | 4/1991 | Lo et al. | 70/25 |
| 5,193,367 | A | | 3/1993 | Ling | 70/28 |
| 5,365,758 | A | | 11/1994 | Shieh | 70/33 |
| 5,442,941 | A | | 8/1995 | Kahonen et al. | 70/34 |
| 5,901,587 | A | * | 5/1999 | Chen | 70/28 |
| 5,987,939 | A | | 11/1999 | Pitisettakarn | 70/33 |
| 6,029,481 | A | * | 2/2000 | Lai | 70/25 |
| 6,439,006 | B1 | * | 8/2002 | Tsai | 70/28 |
| 6,453,706 | B1 | * | 9/2002 | Chen | 70/33 |

* cited by examiner

*Primary Examiner*—John B. Walsh
(74) *Attorney, Agent, or Firm*—Melvin I. Stoltz

(57) ABSTRACT

The combination padlock of the present invention incorporates tumbler or clutch wheel constructions which cooperate with the rotating dials to virtually eliminate any possibility that an unauthorized person would be capable of gaining access to the padlock by known combination lock picking techniques by forming each tumbler or clutch wheel with a plurality of radially extending fins formed thereon, with each of the fins being arcuately spaced from the adjacent fin in a non-symmetrical pattern. Furthermore, the padlock of the present invention incorporates a unique combination setting and re-setting assembly which employs a slider shaft incorporating a radially extending post, which must pass through a key-hold slot formed in the body or housing of the padlock for activating the combination setting or re-setting mode, and cooperates with a set screw member threadedly engaged with the housing or body of the padlock which controls the axial movement of the shaft.

24 Claims, 11 Drawing Sheets

HIGH SECURITY COMBINATION PADLOCK WITH LOCKING BAR

TECHNICAL FIELD

This invention relates to padlocks and, more particularly, to combination padlocks constructed for use in high security and high resistance applications.

BACKGROUND ART

Numerous lock constructions have been developed and are widely employed by individuals to prevent unauthorized persons from gaining access to any area which has been closed and locked. Although many locks are constructed to be opened by a key, numerous combination locks have been developed which are opened by knowledge of a particular combination.

One particular type of combination lock that has become very popular, due to it ease and convenience of use, is a combination lock which employs a plurality of rotatable independent dials, each of which comprises a plurality of indicia, usually numbers or letters, which define the combination for releasing the lock. Although locks of this general nature had been available for several decades, these prior art combination lock constructions are typically employed in low security areas, due to their inability to resist forced entries in which excessive force is applied to the lock.

In those areas wherein a high security lock system is required, prior art constructions have relied upon padlocks which require a key for operating the lock between its alternate open position and closed position. Due to the ease with which keys are often lost or misplaced, as well as the proliferation of the keys required for many individuals to carry, high security padlocks requiring keys for operation has become increasingly unpopular. However, prior art constructions have been incapable of providing a high security padlock incorporating a combination system for operating the padlock.

In addition to prior art, high security padlock constructions relying upon key activation and operation, another problem which has consistently plagued prior art constructions is the cost of construction for producing and assembling prior art padlocks. In order to attain a padlock which provides all of the features desired by the users, prior art constructions typically incorporate numerous small components, each of which require inexpensive assembly procedures to produce the final product. As a result, these prior art high security padlock constructions are typically expensive to produce, thereby reducing the ability of these padlocks to reach a broader base of users.

Another problem commonly found with prior art high security padlocks is the inability of these prior art constructions to prevent contaminants from reaching the internal components of the padlock, thereby causing damage to these components and interfering with the ease of operation of the padlock by authorized personnel. Although numerous attempts have been made to reduce the adverse effect caused by contaminants reaching these components, such attempts have been incapable of satisfactorily eliminating this problem.

A further problem commonly found in prior art high security padlocks is the ability of these locks to be opened by unauthorized individuals using known picking techniques. In particular, since most prior art products employ keys for their operation, unauthorized entry is a common problem.

Therefore, it is a principal object of the present invention to provide a padlock construction which is specifically designed for effective operation in high security applications and is completely operable using a combination system.

Another object of the present invention is to provide a combination padlock construction having the characteristic features described above which virtually eliminates the ability of unauthorized persons from gaining access to the lock by attempting to pick the lock using known techniques.

Another object of the present invention is to provide a combination padlock construction having the characteristic features described above which employs a minimum of components and is quickly and easily assembled, thereby providing a lock capable of being constructed at a competitive price.

Another object to the present invention is to provide a combination padlock having the characteristic features described above which effectively seals the rotating components from external contamination and effectively prevents any external contaminants from reaching the rotating components and thereof.

Other and more specific object will in part be obvious and will in part appear hereinafter.

SUMMARY OF THE INVENTION

By employing the present invention, all of the difficulties and drawbacks of the prior art constructions are fully eliminated and an effective, easily produced, high security padlock is achieved which employs a combination system for fully operating the padlock. Furthermore, the high security, combination padlock of the present invention virtually eliminates the ability of unauthorized persons from opening the padlock using known picking techniques. In addition, the padlock construction of the present invention is designed with the interior chambers thereof virtually sealed from ambient surroundings, thereby preventing unwanted contamination from entering the interior of the lock and/or the rotating components thereof. In this way, the prior art degradation and interference of the lock operation by contamination is virtually eliminated.

In accordance with the present invention, a minimum number of components are employed in combination with a housing and an elongated movable locking bar or shackle in order to provide the desired, unique combination lock construction of this invention. By employing a minimum number of components in the construction of the high security, combination padlock of this invention, a highly efficient and cost effective product is realized.

In addition, the combination padlock of the present invention is constructed from heavy duty metal, such as brass, stainless steel, hardened steel, and the like, with an enlarged, heavy duty locking bar or shackle being employed for providing the desired securement. In addition to assuring that heavy duty, strong, tamper resistant materials are employed, the present invention also employs a tamper-proof holding cavity for the terminating, locking end of the locking bar.

One of the problems that has existed with prior art structures is the ability of unauthorized individuals, seeking to break open a prior art padlock, to be able to forcibly move the locking bar of these prior art padlocks by impacting upon a terminating end of the locking bar. In order to avoid any such possibility with the present invention, the heavy duty, metal based housing or body of the padlock is constructed for cooperating engagement with the terminating, locking end of the locking bar by incorporating an integrally formed receiving cavity within which the locking end is retained. As a result, any unauthorized individual is incapable of gaining access to the terminating, locking end of the locking bar since the terminating, locking end of the locking bar is securely retained within an integrally formed portion of the housing or body.

Another feature incorporated into the combination padlock of the present invention is a unique tumbler or clutch wheel construction which cooperates with the rotating dials to virtually eliminate any possibility that an unauthorized person would be capable of gaining access to the padlock by known combination lock picking techniques. In this unique construction, each tumbler or clutch wheel is constructed with a plurality of radially extending fins formed thereon, with each of the fins being arcuately spaced from the adjacent fin in a non-symmetrical pattern. This non-symmetrical spacing is most easily achieved by having each of the fins arcuately spaced from each adjacent fin by unequal radial distances.

As a result of this construction, in addition to being required to attempt to determine the correct position for each of the rotating dials, an unauthorized individual attempting to use known picking techniques would be required to align each tumbler or clutch wheel in a single correct position while hearing a plurality of "clicks" as each fin aligns with a receiving cavity formed in the housing, even when the other fins are not properly aligned. In this way, numerous false and mis-leading sounds are produced, causing any individual to be completely frustrated and unable to open the padlock of the present invention.

A further feature incorporated into the padlock of the present invention is a break-away handle or knob mounted to the activating slider shaft. In the preferred construction, the tumblers or clutch wheels and dials are mounted about a slider shaft which is axially movable only when the correct combination has been entered on the dials. In order to enable a user to operate the slider shaft, a handle or knob is mounted on one end of the slider shaft.

In normal use, the handle or knob is employed to axially move the slider shaft in order to unlock the shackle or locking bar. For this purpose, the handle/knob is secured to the slider shaft. However, if an unauthorized individual attempts to open the padlock by force and, in exerting this force, applies excessive pressure to the handle/kob in an attempt to forceably move the slider shaft, the break-away feature of the handle/knob causes the handle/knob to be separated from the slider shaft, leaving a slippery, no-grip metal end. Once separated, the handle/knob cannot be attached to the slider/shaft and the attempt to forceably open the padlock will have failed with no further means being available to the unauthorized person.

Another feature incorporated into the padlock of the present invention is a unique combination setting and re-setting assembly which also provides a positive stop mode when the combination re-setting position is not desired. In accordance with the present invention, the slider shaft incorporates a radially extending post which must pass through a key-hole slot formed in the body or housing of the padlock for activating the combination setting or re-setting mode.

In addition, a set-screw member is threadedly engaged with the housing or body of the padlock positioned between the normal, operating position of the radial post and the key-hole slot. As a result, axial movement of the slider shaft during normal operation causes the post to contact the set screw when aligned therewith, thereby preventing accidental entry into the combination setting/resetting mode.

Whenever the user wishes to set or re-set the combination, the set screw must be partially withdrawn from the housing or body in order to enable the radial post to pass the set screw and enter the keyhole slot. In this way, accidental movement of the slider shaft into the set/re-set mode is eliminated and users are assured that only intentionally entered combinations will open the padlock.

The invention accordingly comprises an article of manufacture possessing the features, properties, and the relations of elements which are exemplified in the article described herein and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 1:
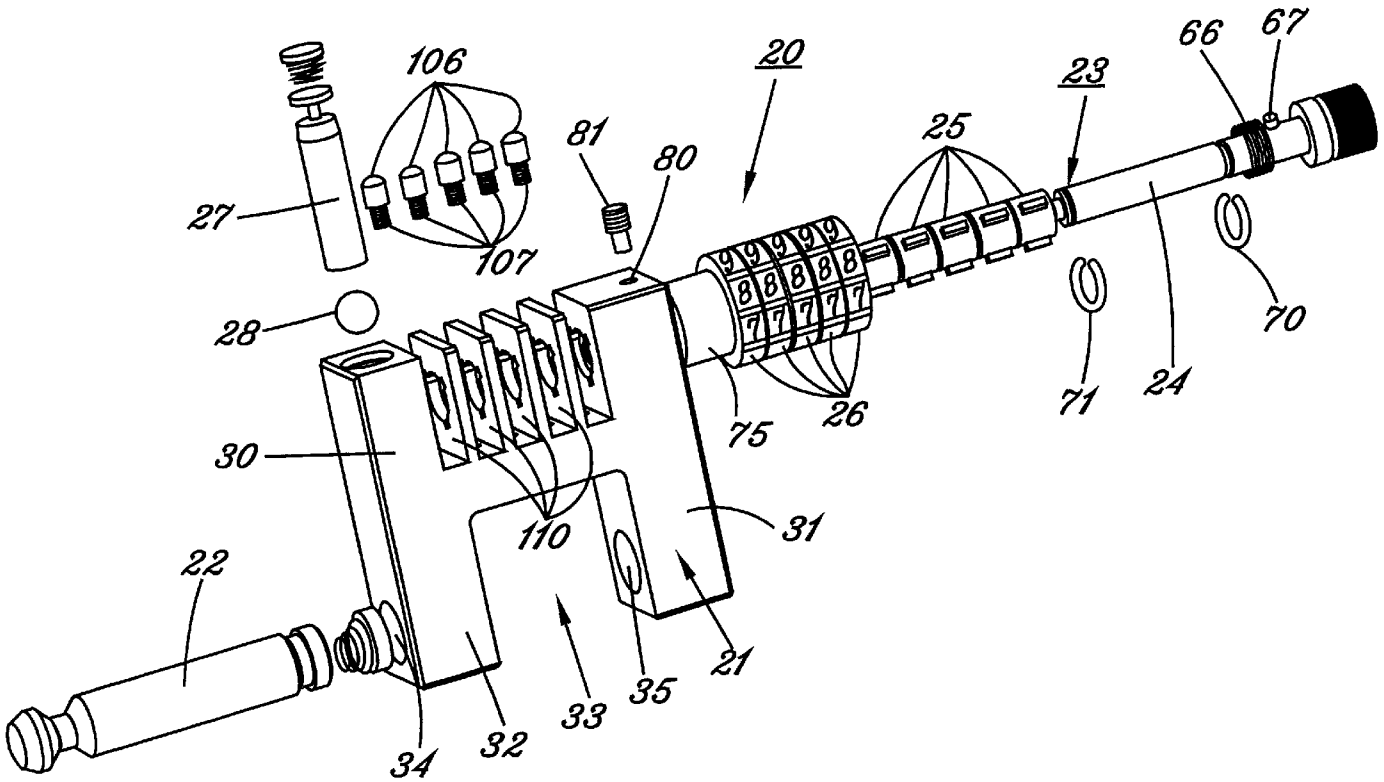
FIG. 1 is an exploded perspective view of the high security, combination padlock of the present invention.

By referring to FIGS. 1–14, along with the following detailed disclosure, the construction and operation of high security combination padlock 20 of the present invention can best be understood. In the drawings and the following detailed disclosure, alternate preferred embodiments of the present invention are fully disclosed. However, the present invention can be implemented using further alternate constructions, which alternate constructions are intended to be within the scope of the present invention. Consequently, the embodiments disclosed herein and shown in the drawings are provided for exemplary purposes only and is not intended as a limitation of the present invention.

In FIGS. 1–10, one embodiment of high security, combination padlock 20 of the present invention is fully depicted using a minimum number of principal components, thereby substantially reducing the complexity found in most prior art combination locks. In addition, this embodiment of the present invention also assures the construction of a secure, tamper resistant product capable of satisfying high security needs. In this way, the present invention provides a highly effective, commercially desirable construction, capable of being produced at a competitive cost, while still providing all of the locking and theft deterrent features typically found in prior art constructions as well as sought by consumers and not found in prior art constructions.

In the present invention, the principal components forming high security, combination padlock 20 comprise housing or body 21, movable locking bar or shackle 22, and a locking/unlocking control assembly 23. In the preferred construction, locking/unlocking control assembly 23 comprises an axially movable slider shaft 24, a plurality of separate and independent tumblers or clutch wheels 25 mounted to slider shaft 24, a plurality of separate and independent rotatable dials 26 controllably associated with tumblers/clutch wheels 25, and cooperating rod 27 and ball 28 positioned for engagement and disengagement with slider shaft 24 and locking bar 22. By employing these principal components, in the unique manner detailed herein, an easily produced, highly effective, high security combination padlock 20 is realized.

In the present invention, housing or body 21 preferably comprises a one-piece construction which is formed from heavy-duty metal, such as brass, stainless steel, hardened steel and the like. In its preferred construction, housing/body 21 comprises an enlarged, thick, heavy-duty, substantially U-shape, defined by central section 30 and arms 31 and 32. Arms 31 and 32 are interconnected to central section 30 and extend therefrom, defining a product locking zone 33 therebetween.

As the best seen in FIGS. 2, 3, 4, and 5, arm 32 of U-shaped housing/body 21 incorporates passageway 34 formed therein, while arm 31 incorporates receiving cavity 35 formed therein. As depicted, passageway 34 and cavity 35 are formed in juxtaposed, spaced, cooperating, co-axially aligned relationship with each other, cooperatively associated with locking zone 33, and effectively forming elongated bore 41.

In addition, U-shaped housing/body 21 incorporates elongated bore 36 which extends through central section 30 and a portion of arm 31, terminating by intersecting passageway 34. Finally, housing/body 21 incorporates elongated bore 37 which extends from a side edge thereof to its terminating position where bore 37 intersects with bore 36.

Elongated bore 37 comprises three separate diameters, forming three separate and independent coaxial zones 38, 39, and 40. As is fully detailed below, elongated bore 37 is constructed for cooperative association with slider shaft 24, and enables the movement of slider shaft 24 to control the locking and unlocking of the bar/shackle 22.

In order to provide a high security, tamper-resistant construction, locking bar or shackle 22 is constructed from heavy-duty, tamper resistant materials, such as stainless steel, hardened steel, and the like, and, preferably comprises an elongated, one-piece, cylindrical or rectangular shape. However, if desired, any alternate configuration can be employed with equal efficacy.

In its preferred construction, locking bar or shackle 22 incorporates opposed, terminating end portions 46 and 47 formed thereon, with end portion 46 comprising a generally rounded terminating surface, while end portion 47 comprises a substantially flat, planar, terminating surface. In addition, channel or groove 48 is formed adjacent terminating end portion 46, with sloping sidewalls 49 formed on both sides thereof, extending from the outer surface of bar/shackle 22 to the base of channel/groove 48.

Furthermore, channel or groove 50 is formed at the opposed end of locking bar/shackle 22, adjacent terminating end portion 47. In this preferred construction, channel/groove 50 is formed with sloping sidewall 51 formed adjacent one side of channel/groove 50, extending from the outer surface of locking bar/shackle 22 to the base of channel/groove 50. However, the opposed side of channel/groove 50 incorporates ledge or step member 52 extending from the base of channel/groove 50 to the outer surface of locking bar/shackle 22. As is more fully detailed below, this construction enables locking bar/shackle 22 to be axially movable through passageway 34 of arm 32 substantially in its entirety, while being prevented from being able to pass completely through passageway 34.

As discussed above, regardless of the overall configuration employed for locking bar or shackle 22, locking bar/shackle 22 must be constructed for longitudinal, axial, translational movement through passageway 34 of arm 31. In this way, locking bar/shackle 22 opens and closes locking zone 33, enabling any desired items to be mounted to locking bar/shackle 22 and be securely retained thereby whenever locking bar/shackle has been moved into its closed, locked position.

In order to enable locking bar/shackle 22 to operate in the desired manner, providing locking and unlocking positions whenever desired by the user, the components which form locking/unlocking control assembly 23 are constructed for controlled, cooperative engagement with locking bar/shackle 22. In this regard, rod 27 comprises an elongated, generally cylindrically shaped member, constructed for axial movement within elongated bore 36 of housing/body 21.

In its preferred construction, rod 27 incorporates substantially flat terminating ends 56 and 57, with channel or groove 58 formed in the outer surface of rod 27 directly adjacent terminating end 57. In its preferred construction, channel or groove 58 comprises sloping sidewalls 59 and 60 formed on opposed sides thereof, extending from the outer surface of rod 27 to the base of groove 58. In addition, as is more fully detailed below, the size and shape of groove 58 with sloping sidewalls 59 and 60 are constructed for cooperative receiving engagement with locking post 65 of slider shaft 24.

Figure 2:
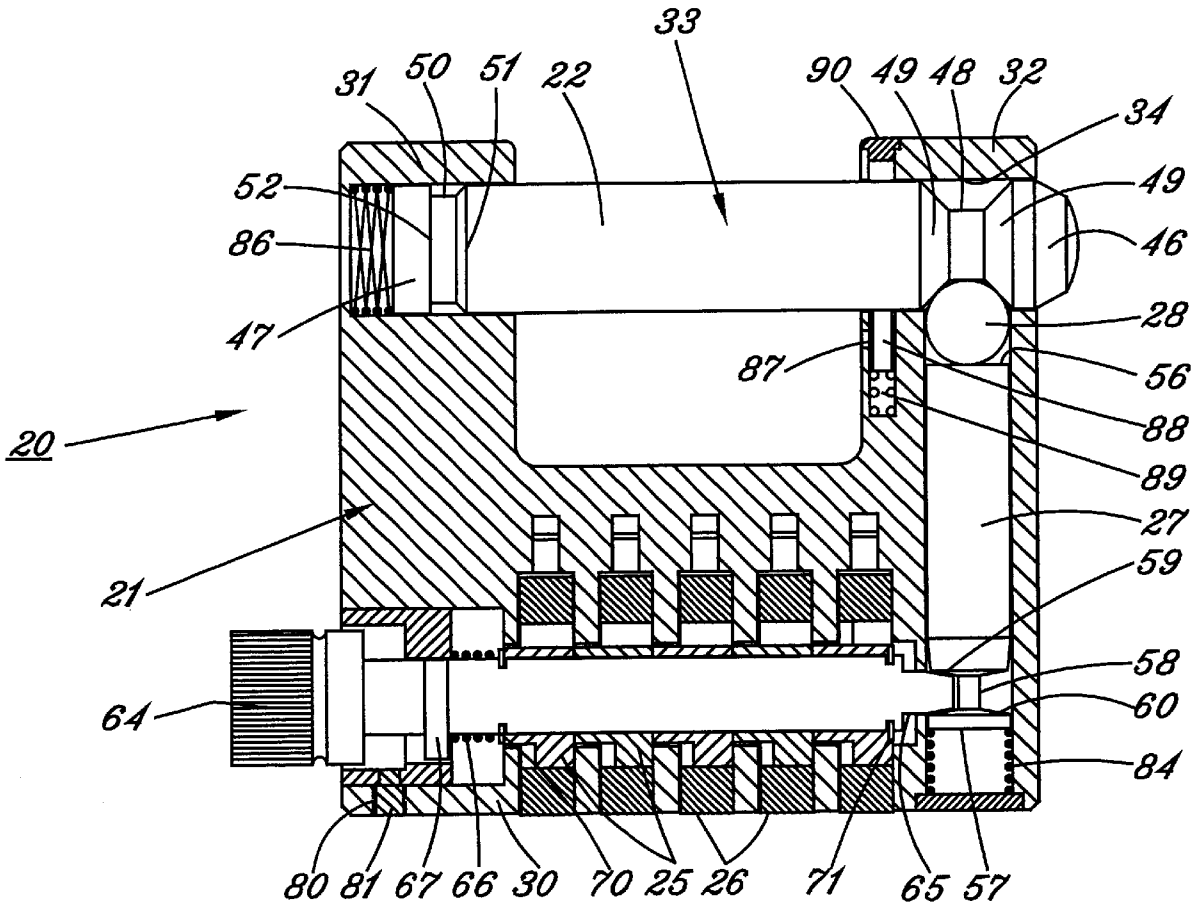
FIG. 2 is a cross-sectional, side elevation view of the high security, combination padlock of FIG. 1, shown in the locked position.
Figure 3:
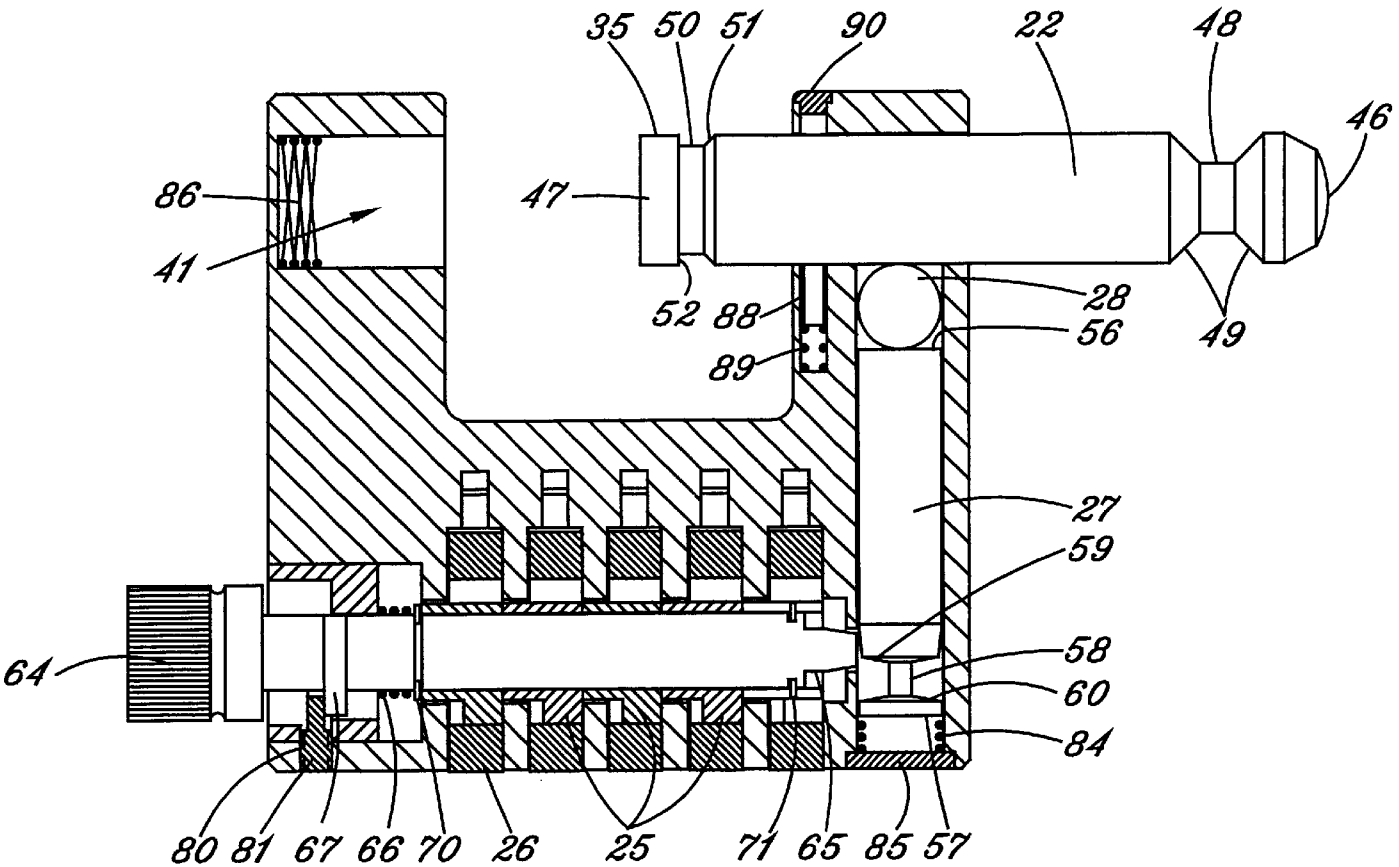
FIG. 3 is a cross-sectional, side elevation view of the high security, combination padlock of FIG. 1, shown in the unlocked position.
Figure 5:
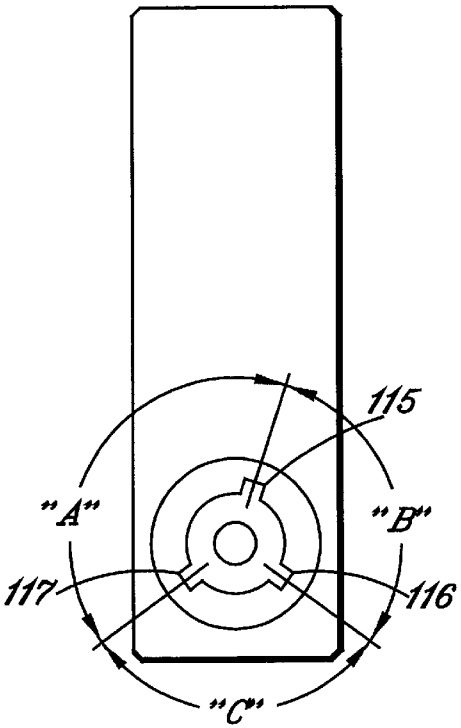
FIG. 5 is a cross-sectional side elevation view of the housing of FIG. 4, taken along line 5—5 of FIG. 4.
Figure 4:
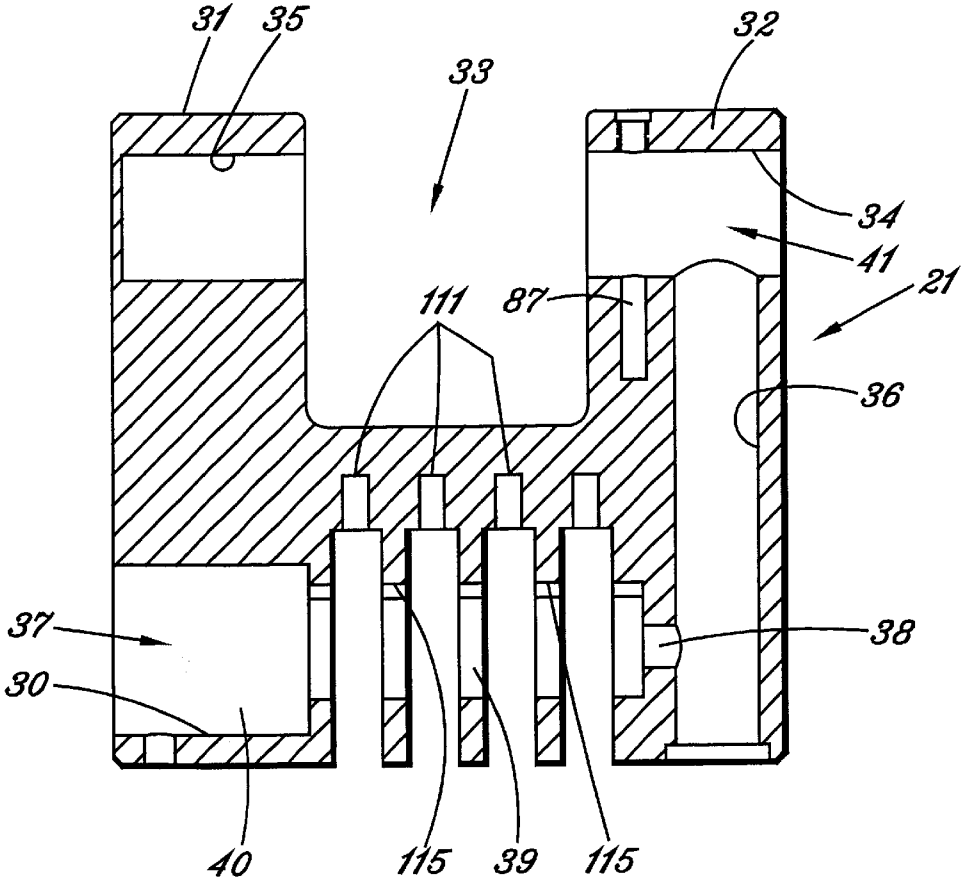
FIG. 4 is a cross-sectional, side elevation view of the housing forming a component of the high security, combination padlock of FIG. 1.
Figure 7:
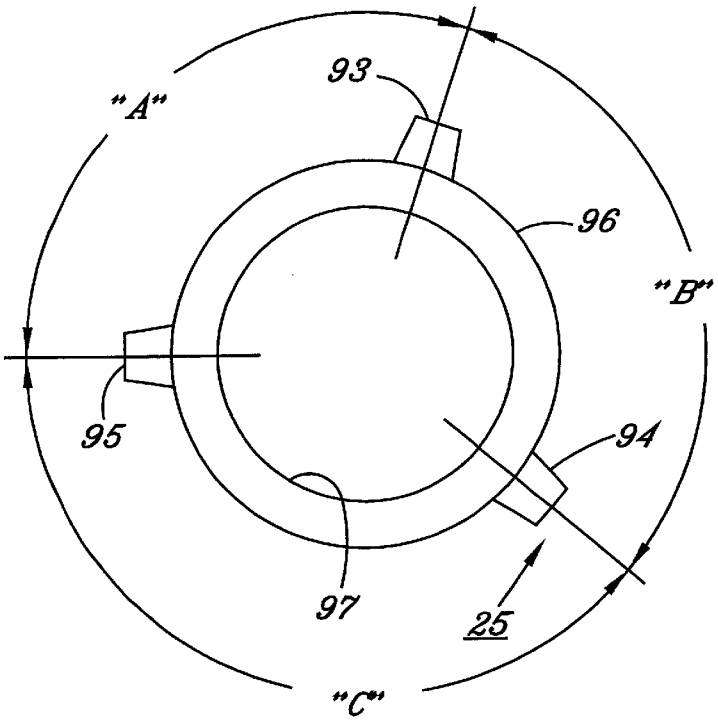
FIG. 7 is a top plan view of one tumbler/clutch wheel forming a component of the high security combination padlock of FIG. 1.
Figure 6:
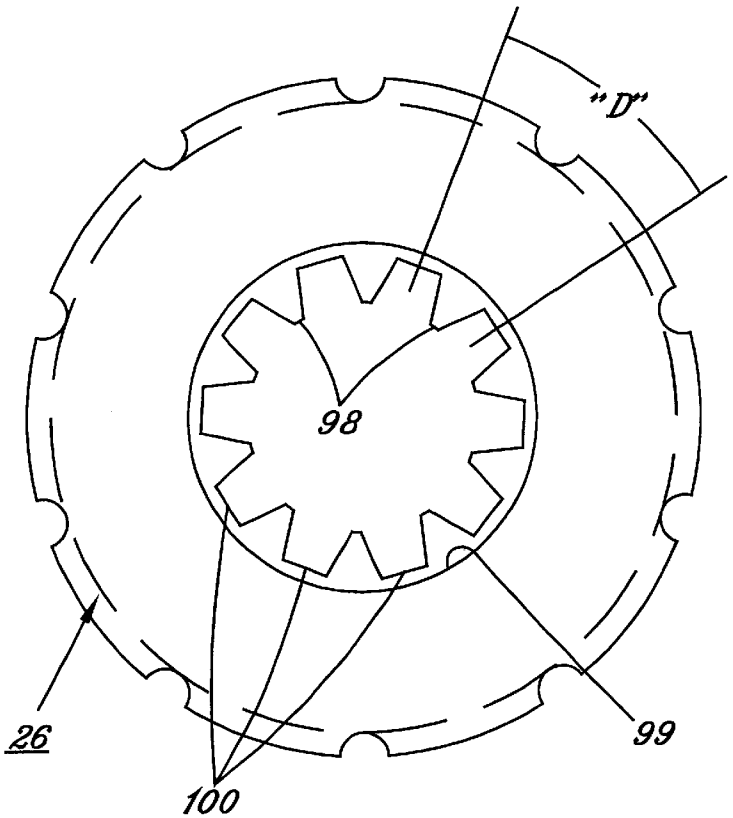
FIG. 6 is a top plan view of one rotatable dial forming a component of the high security, combination padlock of FIG. 1.

In addition, as clearly shown in FIGS. 2 and 3, ball 28 is positioned in elongated bore 36 between terminating end 56 of rod 27 and locking bar/shackle 22. In addition, ball 28 is dimensioned to be movable or positionable in nested, locking interengagement with channel or groove 48 and sloping sidewalls 49 of locking bar/shackle 22. As is more fully detailed below, the movement of ball 28 in groove 36 is completely controlled by the movement of rod 27, which controls ball 28 to be moved between locked interengagement with groove 48 and sidewalls 49 of rod 27 and disengaged therefrom whenever the unlocked position is desired.

As shown in FIGS. 1, 2, and 3, slider shaft 24 preferably comprises an elongated, substantially cylindrically shaped member incorporating an enlarged control knob 64 mounted at one end thereof, with locking post 65 formed at the opposed end thereof. In the preferred construction, locking post 65 comprises a diameter which is smaller than the diameter of slider shaft 24 and is dimensioned for nested, locking engagement in the recess formed by the groove/channel 58 and sloping sidewalls 59 and 60 of rod 27.

In addition, slider shaft 24 is constructed for axial, longitudinal movement in elongated bore 37 of housing/body 21 and incorporates tumblers/clutch wheels 25 and rotatable dials 26 rotationally mounted to the outer surface thereof. In the preferred construction, tumblers/clutch wheels 25 and rotatable dials 26 are capable of freely rotating about slider shaft 24, while also being axially movable along the length of slider shaft 24. However, in order to control and limit the axial, longitudinal movement of rotatable dials 26 and tumblers/clutch wheels 25, while still allowing tumblers/clutch wheels 25 and dials 26 to be freely rotatable about slider shaft 24, locking washers 70 and 71 are securely affixed to slider shaft 24. In this regard, the longitudinal, spaced distance between locking washers 70 and 71 defines the overall longitudinal distance tumblers/clutch wheels 25 are capable of moving, as well as control the axial movement of tumbler/clutch wheels 25 in elongated bore 37 and dials 26.

Furthermore, slider shaft 24 also incorporates spring means 66 mounted to the outer surface thereof between control knob 64 and locking washers 70, while also incorporating a radially extending, movement controlling pin 67 securely mounted in shaft 24 adjacent control knob 64. In its preferred construction, movement controlling pin 67 is securely embedded in slider shaft 24, with a portion thereof radially extending outwardly from the outer surface of shaft 24.

Spring means 66 is maintained under compression, continuously urging slider shaft 24 to move in elongated bore 37 towards rod 27. As more fully detailed below, this longitudinal movement causes slider shaft 23 to automatically move into its locked position, whenever all of the components forming locking/unlocking control assembly 23 are in their proper positions.

Another principal element of high security combination padlock 20 of the present invention is key-way bearing insert 75. As best seen in FIGS. 2 and 3, key-way bearing insert 75 is mounted in larger diameter zone 40 of elongated bore 37. In its preferred construction, insert 75 is press-fitted or friction-fitted into large diameter zone 40 in order to assure that insert 75 cannot be removed from zone 40.

Figure 9:
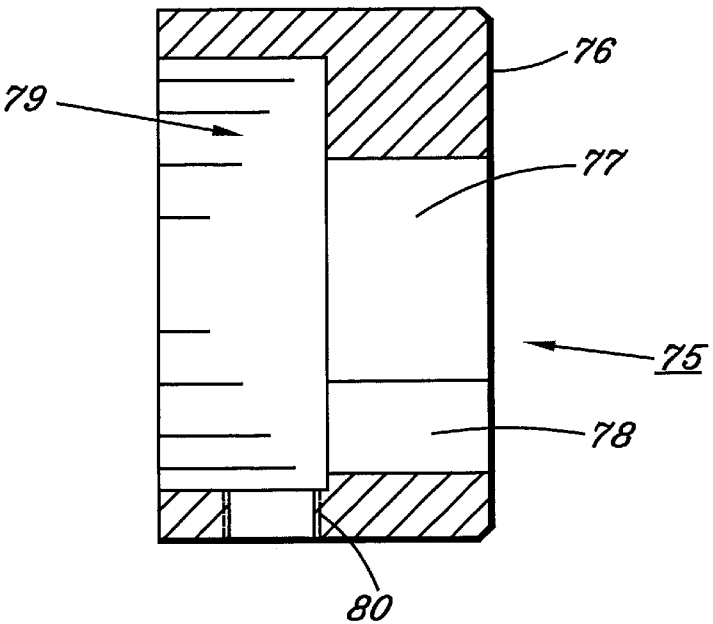
FIG. 9 is a cross-sectional, side elevation view of the keyhole insert of FIG. 8.
Figure 8:
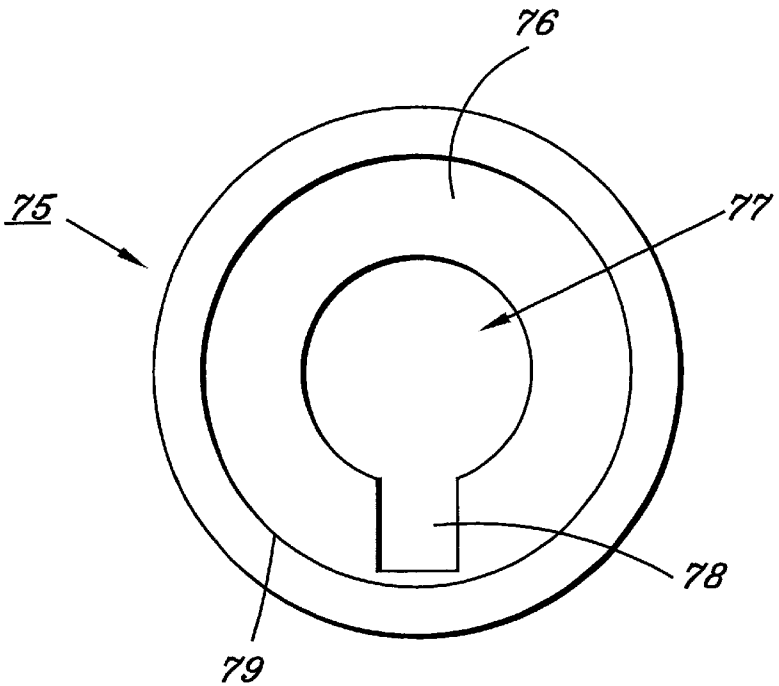
FIG. 8 is a front elevation view of the keyhole insert forming a component of the high security padlock of FIG. 1.

As shown in FIGS. 8 and 9, insert 75 comprises a generally hollow cylindrically shaped member which is closed at one end by wall 76 and comprises an enlarged entry zone 79 formed at the opposed end thereof. In addition, wall 76 incorporates centrally disposed hole or portal 77 and key-way slot 78 extending through wall 76. As a result, an elongated key-way or channel is formed, extending the full width of wall 76, terminating in enlarged entry zone 79. In addition, portal 77 comprises a diameter greater than the diameter of slider shaft 24, in order to enable slider shaft 24 to be axially movable therein.

Once key-way bearing insert 75 is mounted in larger diameter zone 40 of elongated bore 37, the outer surface of wall 76 engages spring means 66 maintaining spring means 66 under compression between wall 76 and locking washer 70. In this way, the desired biasing force is continuously applied to slider shaft 24.

In the preferred construction, housing/body 21 incorporates threaded hole 80 in which set screw 81 is threadedly mounted. Threaded hole 80 is formed in housing/body 21 in a position which is aligned with key-way slot 78 of insert 75, enabling set screw 81 to be advanced through threaded hole 80 into blocking alignment with key-way slot 78.

As shown in FIGS. 2 and 3, when high security, combination padlock 20 of the present invention is fully assembled, radially extending, movement control pin 67 of slider shaft 24 is maintained in key-way slot 78 of insert 75. In this position, slider shaft 24 is able to move into and out of locked and unlocked engagement with the rod 27, while movement control pin 67 is retained within key-way slot 78 for longitudinal movement therein. However, axial movement of slider shaft 24 beyond the unlocked position is prevented, due to the blocking contact of movement control pin 67 with set screw 81 in threaded hole 80.

As is more fully detailed below, set screw 81 is typically advanced into threaded hole 80 in order to position set screw 81 in blocking alignment with key-way slot 78. In this way, axial movement of slider shaft 24 is controlled and limited to its locked and unlocked positions. However, whenever the user wishes to alter the combination represented by rotatable dials 26, set screw 81 is withdrawn from its blocking position with key-way slot 78. Once set screw 81 is removed from blocking alignment with key-way slot 78, slider shaft 24 can be manually moved axially, against the spring forces provided by spring means 66, enabling movement control pin 67 to be withdrawn from key-way slot 78. Once movement control pin 67 is withdrawn from key-way slot 78, slider shaft 24 is capable of rotational movement about its longitudinal axis.

By employing the construction detailed above, slider shaft 24 is continuously urged during normal operation towards rod 27, attempting to cause slider shaft 24 to move into its locked position, with locking post 65 of slider shaft 24 engaged in channel/groove 58 and sloping walls 59 and 60 of rod 27. In addition, whenever this locked position is attained, disengagement and unlocking of padlock 20 is achieved by manually moving slider shaft 24 axially against the forces of spring means 66 to withdraw locking post 65 from engagement in groove 58 and sloping walls 59 and 60 of rod 27.

In the preferred embodiment of the present invention, coil spring member 84 is mounted in elongated bore 36, with one end thereof in contact with flat surface 57 of rod 27, for continuously biasing rod 27 towards locking bar/shackle 22. In order to maintain coil spring member 84 under compression and provide the desired biasing force, plate 85 is mounted to housing/body 21 in contact with the opposed end of coil spring member 84. In the preferred construction, plate 85 is securely affixed to housing/body 21, completely sealing elongated bore 36, after all of the requisite components have been inserted therein.

In addition, heavy-duty coil spring member 86 is mounted at the base of cavity 35 of arms 31 of housing/body 21. By incorporating heavy-duty coil spring member 86 in this position, a powerful biasing force is continuously exerted on locking bar/shackle 22, attempting to force locking bar/shackle 22 outwardly from cavity 36 and enable locking bar/shackle 22 to be axially moved through passageway 34 of arms 32.

As a result of this construction, whenever locking post 65 of slider shaft 24 is withdrawn from engagement in groove 58 of rod 27, the biasing force exerted by heavy-duty coil spring 86 forces locking bar/shackle 22 out of cavity 35. This causes ball 28 to be forced downwardly through elongated bore 36, as ball 28 is forced out of engagement from groove 48 and sidewalls 49 of locking bar/shackle 22.

Once heavy-duty coil spring 86 forces ball 28 to be dislodged from groove 48, locking bar/shackle 22 is able to move longitudinally, dislodging terminating end portion 46 from passageway 34 and enabling the user to manually access terminating end portion 46. In this way, the user is able to longitudinally move locking bar/shackle 22 axially through passageway 34. As is evident from this discussion, the force exerted by coil spring 86 is substantially greater than the force exerted by coil spring 84, thereby enabling the biasing force of coil spring 84 to be overcome in order to allow ball 28 to be dislodged from engagement with groove 48 and sloping sidewalls 49.

In order to prevent locking bar/shackle 22 from being completely removable from passageway 34 of arm 32 of housing/body 21, an elongated hole 87 is formed in arm 32 of housing/body 21, extending from the outer surface of arm 32 with a central axis which is perpendicular to the axis of passageway 34, while also being generally parallel to the axis defined by elongated bore 36. In addition, pin 88 and spring 89 are mounted in passageway 87, positioned in a manner which causes pin 88 to be continuously biased into engagement with locking bar/shackle 22. Once mounted in place, hole 88 is closed and sealed by plate 90.

As best seen in FIGS. 2 and 3, by employing this construction, pin 88 is continuously maintained in contact with the outer surface of locking bar/shackle 22 as locking bar/shackle 22 is axially moved through passageway 34. However, whenever locking bar/shackle 22 is advanced a substantial distance outwardly from passageway 34, pin 88 is forced by spring means 89 into engagement with channel/groove 50 of locking bar/shackle 22.

Once pin 88 is engaged in channel/groove 50, further removal of locking bar/shackle 22 from passageway 34 is prevented due to the blocking engagement of pin 88 with ledge or step member 52. As a result, locking bar/shackle 22 is incapable of being completely removed from passageway 34. However, whenever the user desires to advance locking bar/shackle 22 towards cavity 35, as is required whenever items are to be locked or engaged by padlock 20, axial movement of locking bar/shackle 22 is easily attained, since pin 88 is controllably moved downwardly by sloping sidewall 51, effectively camming pin 88 out of contact with groove/channel 50 of locking bar/shackle 22 and enabling locking bar/shackle 22 to be axially advanced in the desired direction.

By employing this construction, a user is able to open locking zone 33 by longitudinally moving locking bar/shackle 22 through passageway 34. Once the desired item or items have been positioned in locking zone 33, locking bar/shackle 22 is axially moved towards cavity 35, engaging the item/items to be secured in locking zone 33.

In order to secure the item/items to be locked and place combination padlock 20 in its locked position, locking bar/shackle 22 is advanced into cavity 35 of arm 31, against coil spring member 86, until groove 48 is aligned with ball 28. Once in this position, ball 28 is forced upwardly into engagement with groove 48 and sidewalls 49 by spring member 84 acting upon rod 27.

In addition, as rod 27 is moved axially in bore 36 toward locking bar/shackle 22, groove/channel 58 is brought into alignment with locking post 65 of slider shaft 24. As locking post 65 is aligned with groove-channel 58, locking post 65 is forced into secure locked engagement in groove/channel 58 due to the force exerted by spring means 66. When all of these components are fully engaged and secured, as shown in FIG. 2, padlock 20 is in the locked position, enabling dials 26 to rotate out of the pre-set combination alignment, thereby placing padlock 20 in its fully locked, high security configuration.

Another feature of the present invention, which further assures and enhances the high security, tamper-resistant characteristics of padlock 20, is the unique construction of tumblers/clutch wheels 25 and the interaction of tumblers/clutch wheels 25 with housing/body 21. By referring to FIGS. 4–7, along with the following details discussion, this unique construction and operation can best be understood.

In the preferred construction, each tumbler/clutch wheel 25 comprises a generally cylindrical shape incorporating three separate and independent locking fins 93, 94, and 95, each of which radially extend from outer, circular-shaped surface 96. In the preferred construction, locking fins 93, 94, and 95 are positioned on outer surface 96 at arcuate spaced distances, at least one of which is not identical to the other two arcuate distances.

Although a wide variety of arcuate spaced distances can be employed for forming locking fins 93, 94, and 95 on outer surface 96, in the preferred embodiment, locking fins 93 and 94 are spaced apart an arcuate distance "B" of 108°, while locking fins 94 and 95 are spaced apart an arcuate distance "C" of 144°, and locking fins 95 and 93 are spaced apart an arcuate distance "A" of 108°.

Although virtually any desired arcuate distances can be selected for positioning locking fins 93, 94, and 95 on outer surface 96, including having all three arcuate distances separate and distinct from each other, the present invention requires at least one of the arcuate spaced distances to be dissimilar from the other spaced distances, even if two of the arcuate spaced distances are equal. By employing this unique construction, substantial additional difficulty is created for any unauthorized individual attempting to determine the combination using known picking techniques.

Each tumbler/clutch wheel 25 also comprises an inside, circular-shaped surface 97 which is coaxially aligned with outside surface 96. The diameter of inside surface 97 of tumbler/clutch wheel 25 is constructed to enable each tumbler/clutch wheel 25 to freely rotate about the outer surface of locking bar/shackle 22.

Each rotatable dial 26 is constructed for peripherally surrounding and cooperating with one tumbler/clutch wheel 25. In this regard, each dial 26 comprises two separate and distinct, inside surfaces 98 and 99, with inside surface 98 comprising a diameter slightly greater than the diameter of outside surface 96 of tumbler/clutch wheel 25. Inside diameter 99 comprises a diameter slightly greater than the diameter formed by the outer edges of locking fins 93, 94 and 95. In this way, tumblers/clutch wheels 25 and dials 26 are capable of cooperating with each other, while also being independently rotationally movable about locking bar/shackle 22.

Furthermore, each rotatable dial 26 comprises a plurality of slots 100 formed in inside surface 98, with each slot being constructed for receiving and retaining a radially extending fin of tumbler/clutch wheel 25. By employing this construction, whenever radially extending fins 93, 94, and 95 are mounted in corresponding slots 100 of dial 26, tumbler/clutch wheel 25 and dial 26 are in interlocked engagement, causing both members to rotate together about locking bar/shackle 22.

In the preferred construction, in order to assure that locking fins 93, 94 and 95 are capable of being simultaneously engaged in a corresponding slot 100, slots 100 are formed in wheel 26 with an arcuate distance "D" between the center point of each slot 100 which comprises about 36°. Since 36° is a multiple of the arcuate radial distance between each locking fin 93, 94, and 95, assurance is provided that tumbler/clutch wheel 25 is capable of being nested in engagement with slots 100 of dial 26, regardless of the relative positions of these components.

In the preferred construction, the number of slots 100 formed in dial 26 correspond to the number of separate and distinct indicia formed on the outer surface of dial 26. In the preferred embodiment, ten indicia are employed on the outer surface of dial 26, with ten slots 100 being formed in surface 98.

Inside surface 99 of dial 26 comprises a circular shape formed by a diameter which is aligned with the axis of surface 98, but is greater than the overall diameter established by the outside surfaces of locking fins 93, 94 and 95. In this way, whenever locking fins 93, 94 and 95 are disengaged from slots 100 of dial 26, dial 26 is able to rotate about locking bar/shackle 22 independently of tumbler/clutch wheel 25.

Each dial 26 has a plurality of indicia formed on the outer peripheral surface thereof, each of which represents one component of the combination for positioning tumblers/clutch wheels 25 in the requisite location for releasing locking bar/shackle 22. Although any desired indicia can be employed, numerals or letters are typically employed on prior art constructions.

In the present invention, each dial 26 comprises an outer surface 101 on which ten panels 102 are formed with slots 103 separating each panel 102. In addition, one numeral ranging from 0, 1, 2, 3, 4, 5, 6, 7, 8, and 9 is formed on each panel 102. The numerals in each panel 102 of each dial 26 is employed to define the combination for padlock 20.

The final components incorporated into high security, combination padlock 20 of the present invention comprise a plurality of sets of pins 106 and springs 107, which are mounted in a receiving cavity formed in housing/body 21. Although these components are optional, the preferred embodiment incorporates one pin and one spring in direct association with each rotatable dial 26, in order to provide positive position locating means, which also produces an audible sound, each time the precise position of each numeral on dial 26 is reached.

In the preferred construction, each spring 107 is maintained under compression, forcing each pin 106 into engagement with outer surface 101 of dial 26. In addition, with each dial 26 incorporating slots 103 formed between each numeral bearing panel 102, the movement of spring loaded pin 106 into and out of slots 103 causes an audible click, designating the proper orientation of the dial for each numeral. In addition to the audible click produced, the movement of pin 106 into engagement in slot 103 also produces a positive structural indication and rotational stop, indicating that one particular numeral is in its proper orientation.

In addition, a visual indicator designating the proper orientation for each numerals of each panel 102 is also provided by forming a position orienting line on one surface of housing/body 21. And shown in FIG. 1, line 108 is formed on an edge of housing/body 22 for enabling the user to visually position each numeral in the proper location for a preset combination. By employing orientation line 108 along with pins 106 and springs 107, proper orientation of any particular numeral is easily achieved.

As discussed above, housing/body 21 comprises one of the principal components of high security, combination padlock 20 of the present invention. By referring to FIGS. 4 and 5, along with the following detailed discussion, further unique construction attributes of housing/body 21 can best be understood, along with the unique theft deterrent features provided thereby.

As detailed above, housing/body 21 comprises elongated bore 37 within which slider shaft 24 is mounted for controlled operation of padlock 20. In order to accommodate slider shaft 24 and the components associated therewith, elongated bore 37 incorporates three separate and independent coaxial zones 38, 39 and 40, each of which are formed with different diameters. In the preferred construction, zone 38 is dimensioned for receiving and cooperating with the movement of locking post 65 of slider shaft 24. In addition, zone 39 is constructed for receiving and cooperating with tumblers/clutch wheels 25, while zone 40, as detailed above, is constructed for receiving and securely retaining key-way bearing insert 75.

In order to assure that each rotatable dial 26 is cooperatively associated with a tumbler/clutch wheel 25 and is rotatable about slider shaft 24, along with an associated tumbler/clutch wheel 25, housing/body 21 incorporates a plurality of separate and independent dial receiving slots 110. Each dial receiving slot 110 is formed in juxtaposed, spaced, aligned, parallel relationship with each other, while also been cooperatively associated with zone 39 of elongated bore 37.

In addition, each slot 110 is dimensioned to assure that each dial 26 is capable of being freely rotatable about locking bar/shackle 22, whenever rotational movement is enabled by the operation of padlock 20. Finally, each dial receiving zone 110 is cooperatively associated with a cavity 111, within which pin 106 and spring 107 are positioned for engagement with dial 26.

In order to accommodate the construction of tumblers/clutch wheels 25 of the present invention and enable tumblers/clutch wheels 25 to cooperate with rotatable dials 26, to control the locking and unlocking of padlock 20, housing/body 21 also incorporates three separate and independent elongated slots or channels 115, 116, and 117 formed in zone 39 of elongated bore 37, extending substantially the entire length of zone 39. As detailed below, slots/channels 115, 116, and 117 are constructed and positioned for receiving locking fins 93, 94, and 95 of tumblers/clutch wheels 25 whenever tumbler/clutch wheels 25 are placed in the precise, correct, aligned position.

Elongated slots/channels 115, 116, and 117 are formed in zone 39 of elongated bore 37 of housing/body 21 with precise, arcuate spaced distances formed between the center line of each adjacent slot/channel. As clearly shown in FIG. 5, slots/channel 115 is positioned in spaced relationship to slot/channel 117 with an arcuate spaced distance equal to "A", which corresponds to the arcuate, spaced distance existing between locking fins 93 and 95.

In addition, slots/channels 115 and 116 are formed with an arcuate spaced distance therebetween equal to "B", which corresponds to the arcuate spaced distance between locking fins 93 and 94. Finally, slots/channels 116 and 117 have an arcuate spaced distance therebetween equal to "C", which is equivalent to the arcuate spaced distance existing between locking fins 94 and 95.

By employing this construction, each of the three locking fins of each tumbler/clutch wheel 25 must be precisely aligned with each of the three slots/channels 115, 116, and 117 in its single orientation, in order to enable combination padlock 20 to be moved from its locked to its unlocked position. In addition, by employing a plurality of identical tumblers/clutch wheels 25 mounted in housing/body 21 of padlock 20, with each constructed for cooperating with slots/channels 115, 116, and 117, as detailed above, the desired high security, combination padlock 20 is realized which makes it virtually impossible for any unauthorized individual to determine a preset combination, without advance knowledge thereof.

A further feature of the present invention is the ability of high security, combination padlock 20 of the present invention to virtually eliminate unauthorized individuals from gaining access to padlock 20 using known picking techniques. By employing the present invention, well-known, conventional picking techniques are completely thwarted.

As is well-known, the principal technique employed for picking a combination lock is to apply pressure to the slider shaft, while individually rotating the dials and listening for a clicking sound which occurs whenever a locking fin of a tumbler/clutch wheel enters a release channel associated with the tumbler/clutch wheel. Then, by continuously repeating this process, a secure lock is capable of being unlocked, even though the individual does not know the actual combination of that lock.

In the present invention, the ability of padlock 20 to be opened using this technique is virtually eliminated, due to the incorporation of three locking fins on each tumbler/clutch wheel and three corresponding separate and independent release slots/channels. Furthermore, by constructing these components with unequal angular relationships, as detailed above, only one correct orientation exists for aligning each tumbler/clutch wheel 25 with release slots/channels 115, 116, and 117.

As a result of this unique construction, numerous false clicks are produced by padlock 20 of the present invention, whenever an unauthorized individual attempts to unlock padlock 20 using this known technique. These false clicks are generated each time a locking fin is aligned with a release slot/channel while axial pressure is placed on slider shaft 24. Due to the unique construction employed in the present invention, a plurality of the erroneous alignment positions are realized as each dial 26 is rotated. As a result, the easy and quick picking procedure usable with most prior art constructions is eliminated, and a virtually pick-free padlock is realized.

As briefly discussed above, another unique attribute of the present invention is the construction employed for controlling the combination re-setting of padlock 20. By referring to FIG. 10, along with the following detailed discussion, the implementation of the re-setting procedure can best be understood.

In order to activate the combination re-setting position, the user first partially removes set screw 81 from threaded hole 80, a sufficient distance to withdraw set screw 80 from blocking engagement with key-way slot 78 of key-way bearing insert 75. Once set screw 81 has been withdrawn from blocking alignment of key-way slot 78, control knob 64 of slider shaft 24 is pulled against the spring forces provided by spring means 66 in order to cause movement control pin 67 to pass through key-way slot 78 of insert 75.

Once movement control pin 67 is drawn through key-way slot 78, slider shaft 24 is free to rotate about its central axis. In order to secure slider shaft 24 in its withdrawn position, control knob 64 and slider shaft 24 are rotated to enable control pin 67 to be engaged with the inside surface of wall 76. In this way, slider shaft 24 is maintained in the re-setting position.

Figure 10:
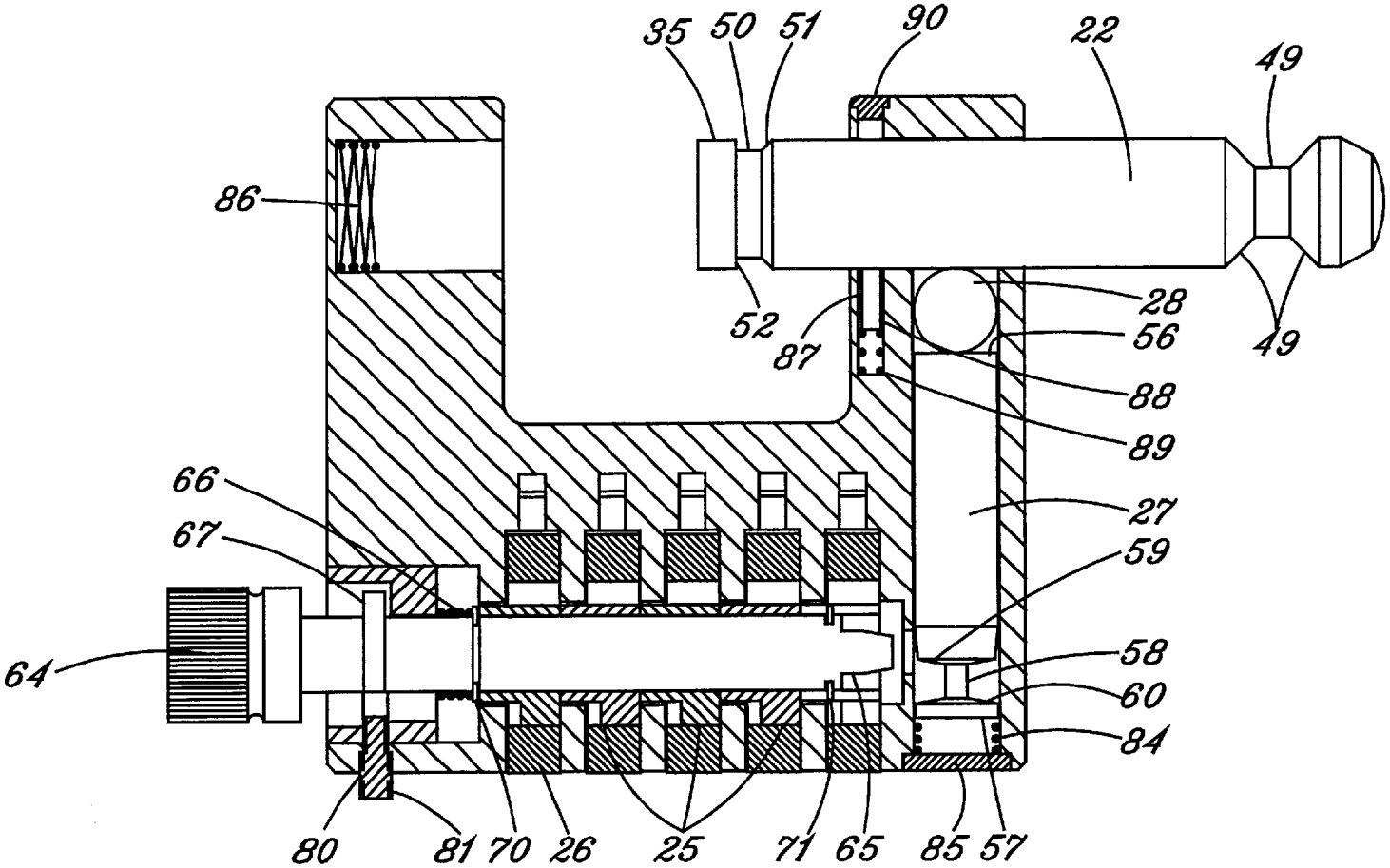
FIG. 10 is a cross-sectional, side elevation view of the high security, combination padlock of FIG. 1 depicted in its combination resetting position.

Whenever slider shaft 24 is axially moved from its unlocked position, shown in FIG. 3, to its combination re-setting position, shown in FIG. 10, tumblers/clutch wheels 25 are forced to move axially with slider shaft 24, due to the sandwiched engagement of tumblers/clutch wheels 25 between locking washers 70 and 71. As a result, whenever slider shaft 24 is moved into the combination re-setting position, locking fins 93, 94, and 95 of each tumbler/clutch wheel 25 are moved entirely into release slots/channels 115, 116, and 117.

In this position, locking fins 93, 94, and 95 of tumbler/clutch wheels 25 are completely disengaged from rotatable dials 26. As a result, rotatable dials 26 are capable of being fully rotated about slider shaft 25, completely independently of tumblers/clutch wheels 25.

Each dial 26 is then arcuately rotated about slider shaft 24 to enable the user to align any desired indicia, or numeral, appearing on panel 102 of dial 26 to be positioned in alignment with combination designating line 108. As a result, by positioning each dial 26 in a precisely desired location, any desired combination can be selected by the user to represent the particular desired combination for opening padlock 20.

Once dials 26 have been arranged in the numerical sequence desired by the user to form the opening combination for padlock 20, slider shaft 24 is rotated about its elongated axis to the position where movement controlling pin 67 is aligned with key-way slot 78 of key-way bearing insert 75. Once this aligned position is reached, spring means 67 automatically causes slider shaft 24 to move axially, attempting to return slider shaft 24 to its locked position.

Once movement control pin 67 of slider shaft 24 has been moved beyond threaded hole 80, set screw 81 is threadedly advanced in threaded hole 80, returning set screw 81 into blocking aligned engagement within key-way slot 78. Once in this position, axial movement of slider shaft 24 into its re-setting position cannot be attained.

As is evident from the foregoing detailed disclosure, by employing the construction detailed herein, a uniquely constructed high security, combination padlock is obtained which provides all of the desired functions of a high security combination padlock in a highly effective, easily assembled and easily employed construction, capable of being produced with substantially greater ease and convenience. Furthermore, the construction of the present invention incorporates a plurality of means for producing false clicks, thereby effectively attaining a high security, combination padlock which virtually eliminates unauthorized individuals from gaining access to the combination padlock, when in its locked position, using conventional picking techniques.

In FIGS. 11–14, two alternate embodiments of high security combination padlock 20 of the present invention are fully depicted. As with the embodiment detailed above, these two alternate embodiments also employ a minimum number of principal components, thereby substantially reducing the complexity found in most prior art combination locks. In addition, these embodiments also assure the construction of a secure, tamper-resistant product capable of satisfying high security needs. In this way, these embodiments provide a highly effective, commercially desirable construction, capable of being produced at a competitive cost, while still providing all of the locking and theft deterrent features found in the embodiment defined above, as well as sought by consumers and not found in prior art constructions.

In the following detailed disclosure of the embodiment of FIGS. 11–14, similar numerals will be employed for the similar components defined above. In this regard, the principal components forming high security, combination padlock 20 of FIGS. 11, 12, 13 and 14 comprise housing or body 21, movable locking bar or shackle 22, and a locking/unlocking control assembly 23. In these alternate constructions, locking/unlocking control assembly 23 comprises an axially movable slider shaft 24, a plurality of separate and independent tumblers or clutch wheels 25 mounted to slider shaft 24, and a plurality of separate and independent rotatable dials 26 controllably associated with tumblers/clutch 25. By employing these principal components, in the unique manner detailed herein, an easily produced, highly effective, high security combination padlock 20 is realized in two further alternate constructions.

In the present invention, housing or body 21 preferably comprises a one-piece construction which is formed from heavy-duty metal, such as brass, stainless steel, hardened steel and the like. In this construction, housing/body 21 comprises an enlarged, thick, heavy-duty member which incorporates cut-out or open zone 133 defining product locking zone 33.

In these embodiments, housing/body 21 incorporates elongated bore 135 which extends substantially the entire width of housing/body 21 and passes through cut-out zone 133/product locking zone 33. By employing this construction, elongated bore 135 forms passageway 34 and receiving cavity 35. As depicted, passageway 34 and cavity 35 are formed in juxtaposed, spaced, cooperating co-axially aligned relationship with each other, cooperatively associated with locking zone 33.

In addition, housing/body 21 incorporates elongated bore 37 which extends substantially the entire length of housing/body 21, from its base to its terminating position where bore 37 intersects with bore 133 and passageway 34 thereof.

Figure 11:
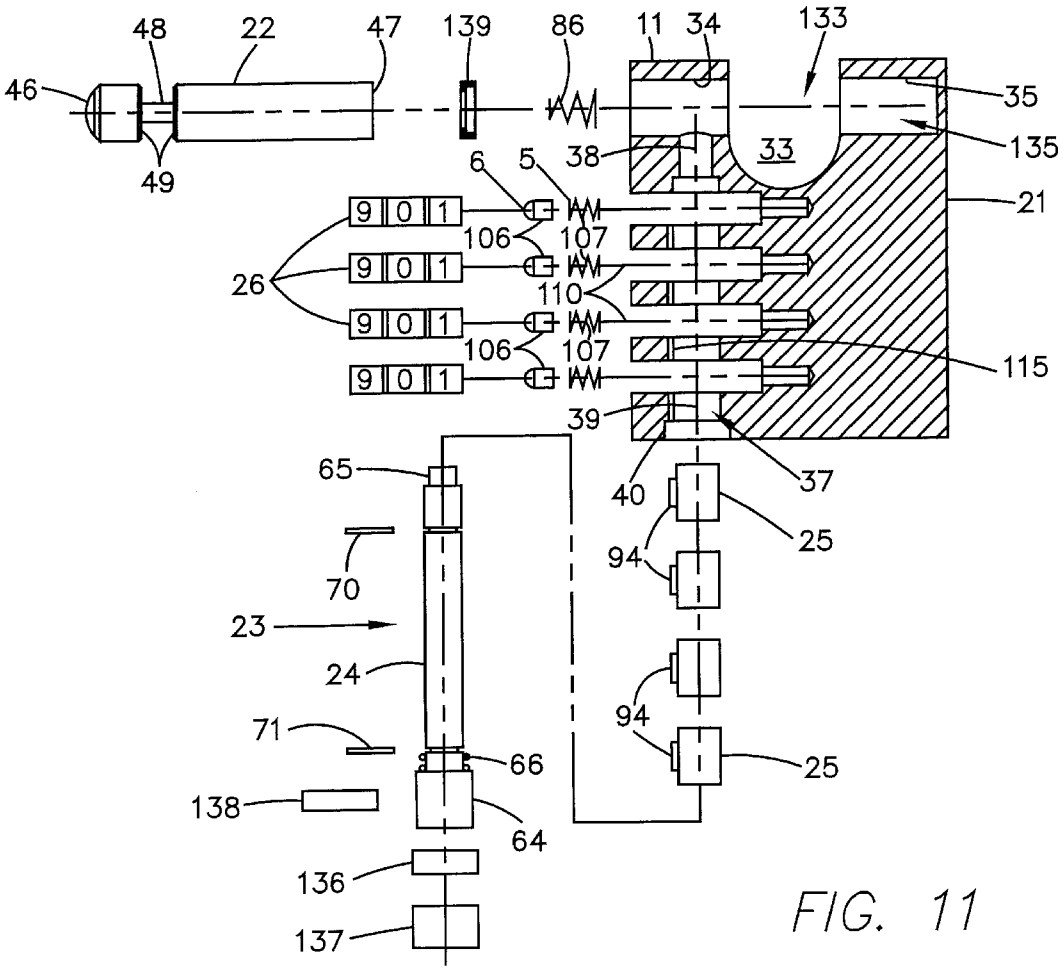
FIG. 11 is an exploded, side elevation view, partially in cross-section, of another embodiment of the high security combination padlock of the present invention.
Figure 12:
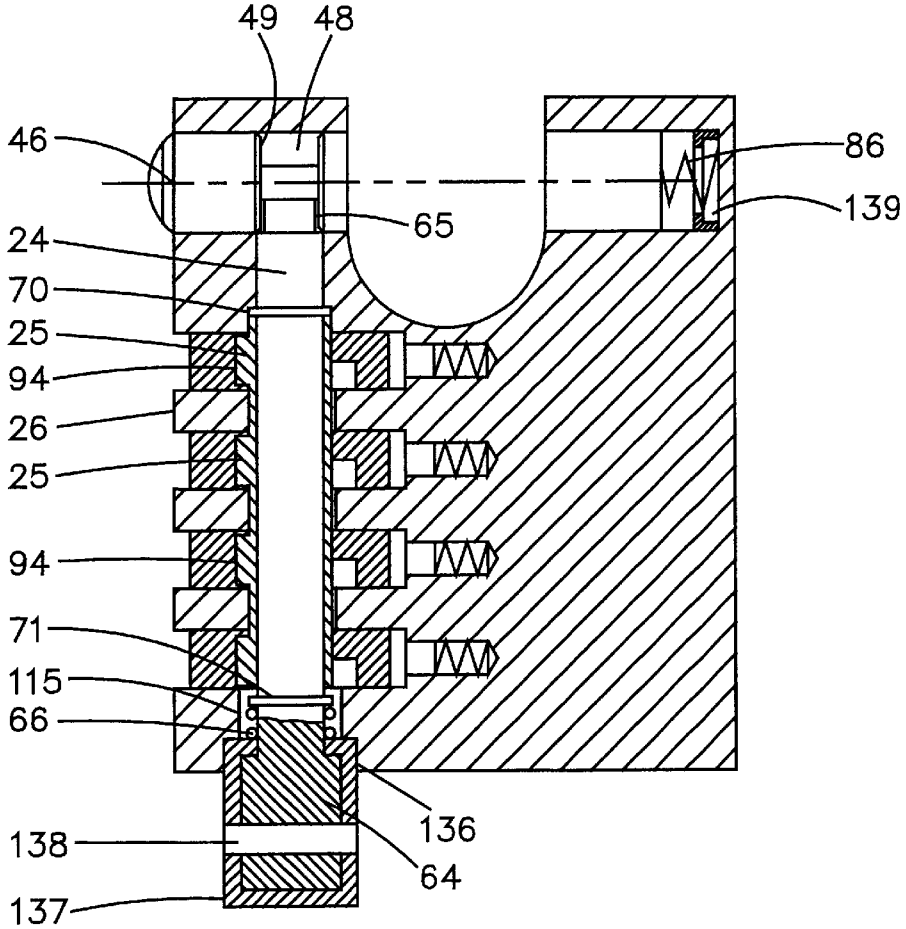
FIG. 12 is a cross-sectional, side elevation view of the high security combination padlock of FIG. 11.
Figure 13:
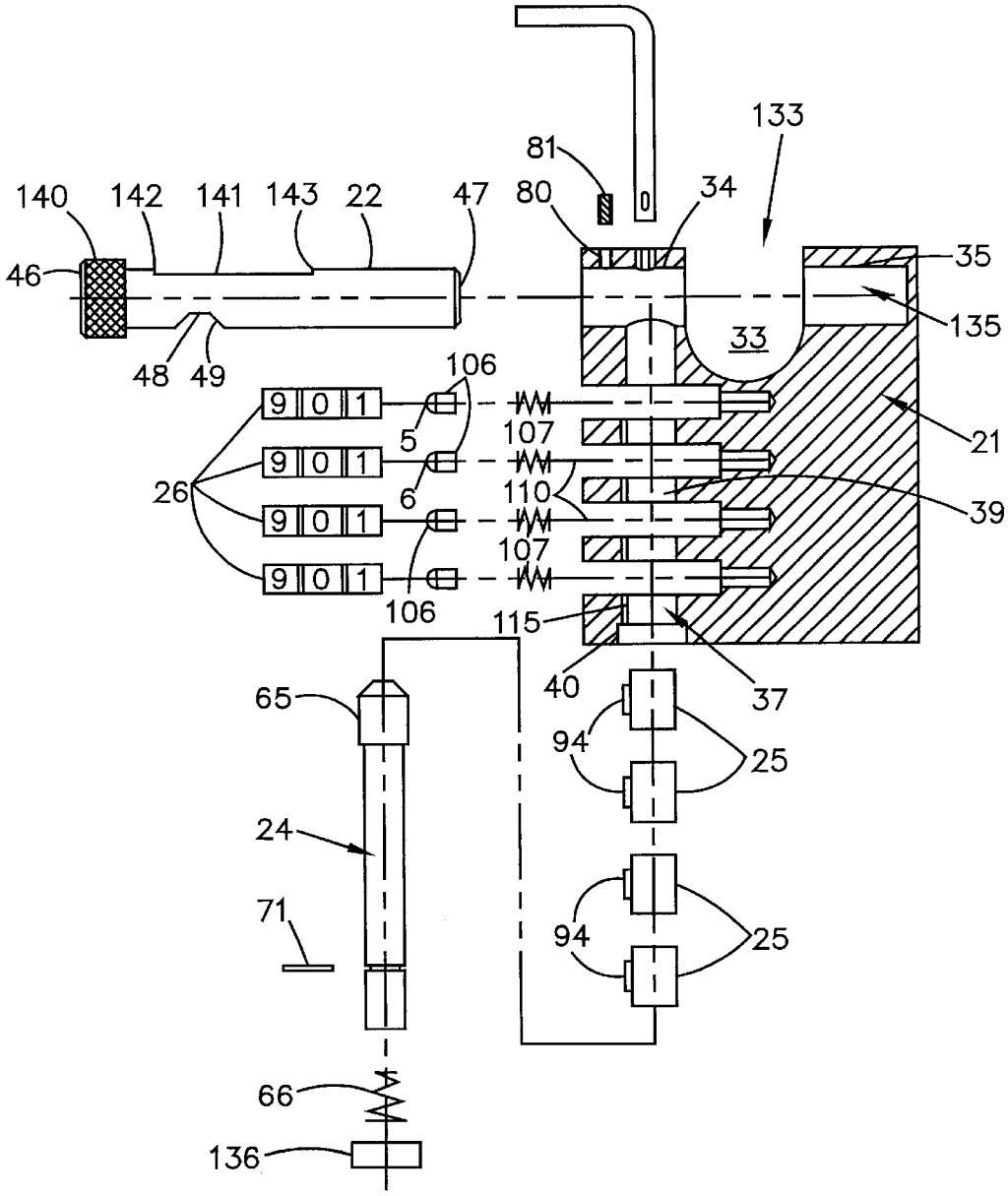
FIG. 13 is an exploded, side elevation view, partially in cross-section of a still further embodiment of the high security combination padlock of the present invention.
Figure 14:
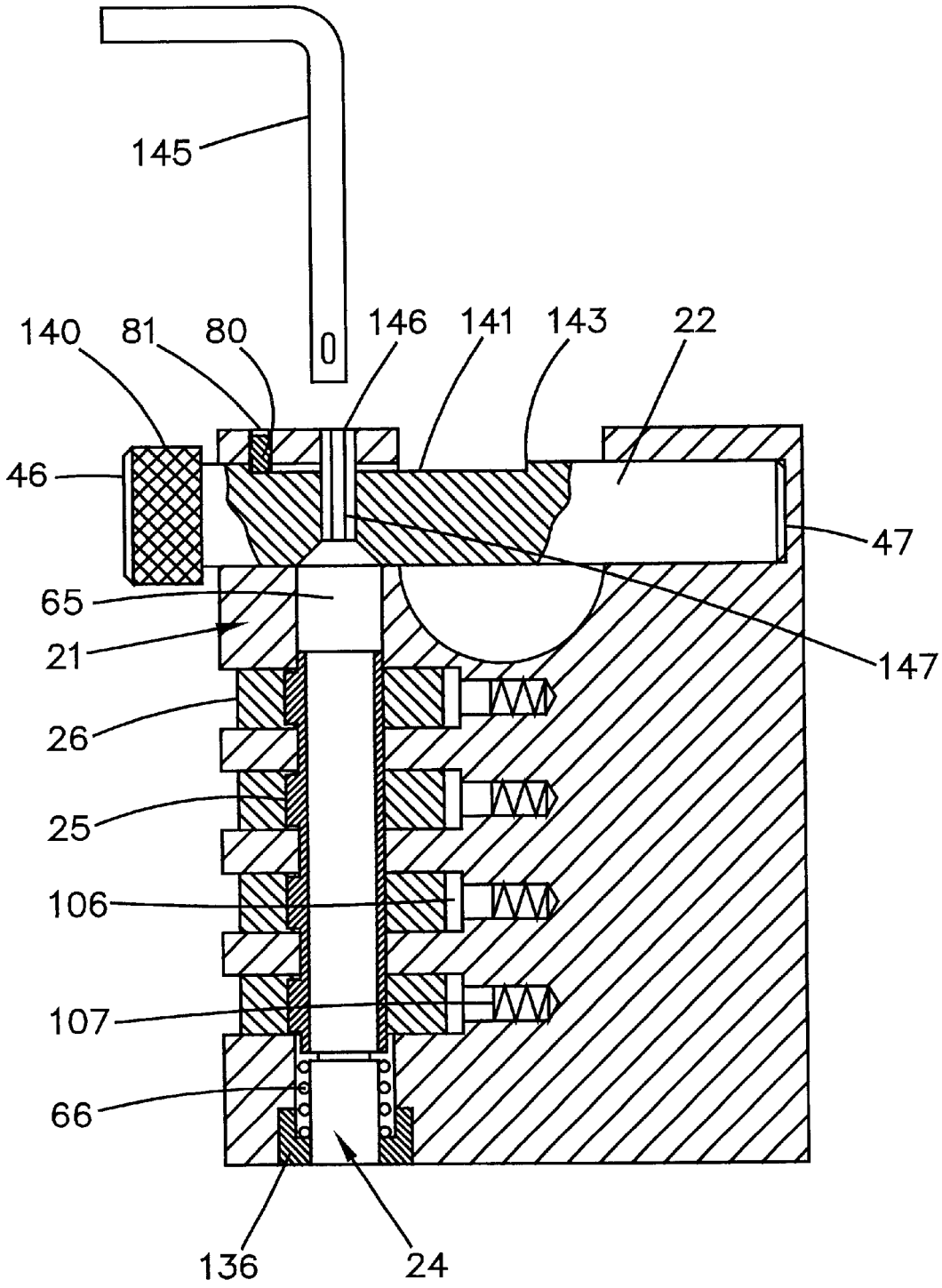
FIG. 14 is a cross-section, side elevation view of the high security combination padlock of FIG. 13.

In the embodiments of FIGS. 11 and 12, elongated bore 37 comprises three separate diameters, forming three separate and independent coaxial zones 38, 39, and 40. In the embodiment of FIGS. 13 and 14, elongated bore 37 comprises three zones 38, 39, and 40. However, the diameters of zones 38 and 39 are substantially equal. As is fully detailed below, elongated bore 37 is constructed for cooperative association with slider shaft 24, and enables the movement of slider shaft 24 to control the locking and unlocking of locking bar/shackle 22.

In order to provide a high security, tamper-resistant construction, locking bar or shackle 22 is constructed from heavy-duty, tamper resistant materials, such as stainless steel, hardened steel, and the like, and, preferably comprises an elongated, one-piece, cylindrical or rectangular shape. However, if desired, any alternate configuration can be employed with equal efficacy.

Dealing now with the preferred construction of the embodiment of FIGS. 11 and 12, locking bar or shackle 12 incorporates opposed, terminating end portions 46 and 47 formed thereon, with end portion 46 comprising a generally rounded terminating surface, while end portion 47 comprises a substantially flat, planar, terminating surface. In addition, channel or groove 48 is formed adjacent terminating end portion 46, with substantially flat sidewalls 49 formed on both sides thereof, extending substantially perpendicularly from the outer surface of bar/shackle 22 to the base of channel/groove 48.

As discussed above, regardless of the overall configuration employed for locking bar or shackle 22, locking bar/shackle 22 must be constructed for longitudinal, axial, translational movement through bore 135. In this way, locking bar/shackle 22 opens and closes locking zone 33, enabling any desired items to be mounted to locking bar/shackle 22 and be securely retained thereby whenever locking bar/shackle has been moved into its closed, locked position.

In order to enable locking bar/shackle 22 to operate in the desired manner, providing locking and unlocking positions whenever desired by the user, the components which form locking/unlocking control assembly 23 are constructed for controlled, cooperative engagement with locking bar/shackle 22.

In this embodiment, slider shaft 24 comprises an elongated, substantially cylindrically shaped member incorporating an enlarged control knob 64 mounted at one end thereof, with locking post 65 formed at the opposed end thereof. In the preferred construction, locking post 65 comprises a diameter which is smaller than the diameter of slider shaft 24 and is dimensioned for nested, locking engagement in the recess formed by the groove/channel 48 and sidewalls 49 of shackle 22.

In addition, slider shaft 24 is constructed for axial, longitudinal movement in elongated bore 37 of housing/body 21 and incorporates tumblers/clutch wheels 25 and rotatable dials 26 rotationally mounted to the outer surface thereof. In the preferred construction, tumblers/clutch wheels 25 and rotatable dials 26 are capable of freely rotating about slider shaft 24, while also being axially movable along the length of slider shaft 24. However, in order to control and limit the axial, longitudinal movement of rotatable dials 26 and tumblers/clutch wheels 25, while still allowing tumblers/clutch wheels 25 and dials 26 to be freely rotatable about slider shaft 24, locking washers 70 and 71 are securely affixed to slider shaft 24. In this regard, the longitudinal, spaced distance between locking washers 70 and 71 defines the overall longitudinal distance tumblers/clutch wheels 25 are capable of moving, as well as control the axial movement of tumbler/clutch wheels 25 in elongated bore 37 and dials 26.

Furthermore, slider shaft 24 also incorporates spring means 66 mounted to the outer surface thereof between control knob 64 and locking washers 70. In addition, plug 136 is also preferably employed and is mounted in enlarged zone 40 of elongated bore 37. By employing plug 136, a fixed surface is provided for maintaining spring 66 in biasing engagement with lock washer 71. Furthermore, plug 136 provides a positive stop surface for control knob 64.

As discussed above, spring means 66 is maintained under compression, continuously urging slider shaft 24 to move in elongated bore 37 towards locking bar/shackle 22. This longitudinal movement causes slider shaft 23 to automatically move into its locked position, whenever all of the components forming locking/unlocking control assembly 23 are in their proper positions.

If desired, breakaway cover 137 is mounted to control knob 64 in peripherally surrounding engagement. Preferably cover 137 is affixed to knob 64 by pin 138.

By employing this construction, any unauthorized person, who attempts to forceably unlock padlock 20 by pulling control knob 64, would merely cause cover 137 to be dislodged or broken away from knob 64 by breaking pin 137. Once removed, the smooth outer surface construction of knob 64 would prevent anyone from being able to use knob 64 to activate slider 24. As a result, such forced break-in attempts would fail.

By employing the construction detailed above, slider shaft 24 is continuously urged during normal operation towards locking bar/shackle 22, attempting to cause slider shaft 24 to move into its locked position, with locking post 65 of slider shaft 24 engaged in channel/groove 48 and sloping walls 49 of locking bar/shackle 22. In addition, whenever this locked position is attained, disengagement and unlocking of padlock 20 is achieved by manually moving slider shaft 24 axially against the forces of spring means 66 to withdraw locking post 65 from engagement in groove 48 and sloping walls 49 of locking bar/shackle 22.

In this embodiment, heavy-duty coil spring member 86 is mounted at the base of cavity 35 of housing/body 21, in combination with spring guard 139. By incorporating heavy-duty coil spring member 86 in this position, a powerful biasing force is continuously exerted on locking bar/shackle 22, attempting to force locking bar/shackle 22 outwardly from cavity 36 and enable locking bar/shackle 22 to be axially moved through passageway 34.

As a result of this construction, whenever locking post 65 of slider shaft 24 is withdrawn from engagement in groove 48 of locking bar/shackle 22, the biasing force exerted by heavy-duty coil spring 86 forces locking bar/shackle 22 out of cavity 35. This enables locking bar/shackle 22 to move longitudinally, dislodging terminating end portion 46 from passageway 34 and enabling the user to manually access terminating end portion 46. In this way, the user is able to longitudinally move locking bar/shackle 22 axially through passageway 34.

By employing this construction, a user is able to open locking zone 33 by longitudinally moving locking bar/shackle 22 through passageway 34. Once the desired item or items have been positioned in locking zone 33, locking bar/shackle 22 is axially moved towards cavity 35, engaging the item/items to be secured in locking zone 33.

In order to secure the item/items to be locked and place combination padlock 20 in its locked position, locking bar/shackle 22 is advanced into cavity 35, against coil spring member 86, until groove 48 is aligned with locking post 65 of slider shaft 24. Once in this position, slider shaft 24 is forced upwardly into engagement with groove 48 and sidewalls 49 by spring member 66 acting upon slider shaft 24.

When all of these components are fully engaged and secured, as shown in FIG. 12, padlock 20 is in the locked position, enabling dials 26 to rotate out of the pre-set combination alignment, thereby placing padlock 20 in its fully locked, high security configuration.

As detailed above, another feature of the present invention, which further assures and enhances the high security, tamper-resistant characteristics of padlock 20, is the unique construction of tumblers/clutch wheels 25 and the interaction of tumblers/clutch wheels 25 with housing/body 21. By referring to FIGS. 4–7 and the following detailed discussion provided above, this unique construction and operation is fully understood.

For simplicity, the embodiment of FIGS. 11 and 12 is depicted with a single elongated slot or channel 115 formed in elongated bore 37 and a single locking fin 94 mounted to each tumbler/clutch wheel 25. However, if desired, this embodiment of padlock 20 can be constructed with three fins mounted to each tumbler/clutch wheel 25 and three grooves or channels formed in elongated bore 37, as detailed above. In addition, the remaining detailed discussion provided above for tumbler/clutch wheels 25, rotatable dials 26, pins 106, and spring 107 has equal applicability to the construction of these components in this embodiment. Consequently, the foregoing detailed disclosure is repeated herein by reference with equal applicability.

As detailed above, housing/body 21 comprises elongated bore 37 within which slider shaft 24 is mounted for controlled operation of padlock 20. In order to accommodate slider shaft 24 and the components associated therewith, elongated bore 37 incorporates three separate and independent coaxial zones 38, 39 and 40, each of which are formed with different diameters. In the preferred construction, zone 38 is dimensioned for receiving and cooperating with the movement of locking post 65 of slider shaft 24. In addition, zone 39 is constructed for receiving and cooperating with tumblers/clutch wheels 25, while zone 40, as detailed above, is constructed for receiving and securely retaining plug 136.

In order to assure that each rotatable dial 26 is cooperatively associated with a tumbler/clutch wheel 25 and is rotatable about slider shaft 24, along with an associated tumbler/clutch wheel 25, housing/body 21 incorporates a plurality of separate and independent dial receiving slots 110. Each dial receiving slot 110 is formed in juxtaposed, spaced, aligned, parallel relationship with each other, while also been cooperatively associated with zone 39 of elongated bore 37.

In addition, each slot 110 is dimensioned to assure that each dial 26 is capable of being freely rotatable about locking bar/shackle 22, whenever rotational movement is enabled by the operation of padlock 20. Finally, each dial receiving zone 110 is cooperatively associated with a cavity 111, within which pin 106 and spring 107 are positioned for engagement with dial 26.

In order to accommodate the construction of tumblers/clutch wheels 25 of the present invention and enable tumblers/clutch wheels 25 to cooperate with rotatable dials 26, to control the locking and unlocking of padlock 20, housing/body 21 of this embodiment incorporates elongated slot or channel 115, formed in zone 39 of elongated bore 37, extending substantially the entire length of zone 39. As detailed above, slot/channel 115 is constructed and positioned for receiving locking fin 94 of tumblers/clutch wheels 25 whenever tumbler/clutch wheels 25 are placed in the precise, correct, aligned position.

In this embodiment, the desired combination is set or reset by axially withdrawing slider shaft 24 from engagement with locking bar/shackle 22 and continuing this axial movement until spring means 66 is fully compressed. Whenever slider shaft 24 is axially moved to its combination re-setting position, tumblers/clutch wheels 25 are forced to move axially with slider shaft 24, due to the sandwiched engagement of tumblers/clutch wheels 25 between locking washers 70 and 71. As a result, whenever slider shaft 24 is moved into the combination re-setting position, each locking fin 94 of each tumbler/clutch wheel 25 is moved entirely into release slots/channel 115.

In this position, locking fin 94 of tumbler/clutch wheels 25 is completely disengaged from rotatable dials 26. As a result, rotatable dials 26 are capable of being fully rotated about slider shaft 25, completely independently of tumblers/clutch wheels 25.

Each dial 26 is then arcuately rotated about slider shaft 24 to enable the user to align any desired indicia, or numeral, appearing on panel 102 of dial 26 to be positioned in alignment with combination designating line 108. As a result, by positioning each dial 26 in a precisely desired location, any desired combination can be selected by the user to represent the particular desired combination for opening padlock 20.

Once dials 26 have been arranged in the numerical sequence desired by the user to form the opening combination for padlock 20, slider shaft 24 is released, enabling spring means 66 to cause slider shaft 24 to move axially, returning slider shaft 24 to its locked position.

Dealing now with the preferred construction of the final embodiment shown in FIGS. 13 and 14, locking bar or shackle 22 incorporates opposed, terminating end portions 46 and 47 formed therein, with end portion 46 comprising an elongated knob 140, while end portion 47 comprises a substantially flat, planar, terminating surface. In addition, notch or groove 48 is formed adjacent knob 140 on one side of locking bar/shackle 22 while elongated, axially extending channel 141 is formed on the opposed side of locking bar/shackle 22. Preferably, notch 48 incorporates sloping side walls 49, while channel 141 extends a substantial axial distance along locking bar/shackle 22, terminating with side walls 142 and 143 at opposed ends thereof.

As discussed above, regardless of the overall configuration employed for locking bar or shackle 22, locking bar/shackle 22 must be constructed for longitudinal, axial, translational movement through bore 135. In this way, locking bar/shackle 22 opens and closes locking zone 33, enabling any desired items to be mounted to locking bar/shackle 22 and be securely retained thereby whenever locking bar/shackle has been moved into its closed, locked position.

In order to enable locking bar/shackle 22 to operate in the desired manner, providing locking and unlocking positions whenever desired by the user, the components which form locking/unlocking control assembly 23 are constructed for controlled, cooperative engagement with locking bar/shackle 22. In this embodiment, slider shaft 24 comprises an elongated, substantially cylindrically shaped member incorporating an enlarged locking post 65 formed at one end thereof. In the preferred construction, locking post 65 comprises a diameter which is greater than the diameter of slider shaft 24, which also incorporates a terminating end which is constructed for nested, locking engagement in notch 48 and sidewalls 49 of shackle 22.

In addition, slider shaft 24 is constructed for axial, longitudinal movement in elongated bore 37 of housing/body 21 and incorporates tumblers/clutch wheels 25 and rotatable dials 26 rotationally mounted to the outer surface thereof. In the preferred construction, tumblers/clutch wheels 25 and rotatable dials 26 are capable of freely rotating about slider shaft 24, while also being axially movable along the length of slider shaft 24. However, in order to control and limit the axial, longitudinal movement of rotatable dials 26 and tumblers/clutch wheels 25, while still allowing tumblers/clutch wheels 25 and dials 26 to be freely rotatable about slider shaft 24, locking washer 71 is securely affixed to slider shaft 24. In this regard, the longitudinal, spaced distance between locking washer 71 and locking post 65 defines the overall longitudinal distance tumblers/clutch wheels 25 are capable of moving, as well as control the axial movement of tumbler/clutch wheels 25 in elongated bore 37 and dials 26.

Furthermore, slider shaft 24 also incorporates spring means 66 mounted to the outer surface thereof between plug 136 and locking washers 71. In addition, plug 136 is preferably employed and is mounted in enlarged zone 40 of elongated bore 37. By employing plug 136, a fixed surface is provided for maintaining spring 66 in biasing engagement with lock waster 71. Furthermore, plug 136 provides a positive stop surface for the end of slider shaft 24.

As discussed above, spring means 66 is maintained under compression, continuously urging slider shaft 24 to move in elongated bore 37 towards locking bar/shackle 22. This longitudinal movement causes slider shaft 23 to automatically move into its locked position, whenever all of the components forming locking/unlocking control assembly 23 are in their proper positions.

In the preferred construction of this embodiment, housing/body 21 incorporates threaded hole 80 in which set screw 81 is threadedly mounted. Threaded hole 80 is formed in housing/body 21 in a position which is aligned and cooperates with channel 141 of locking bar/shackle 22. By employing this construction, set screw 81 is advanced through threaded hole 80 into blocking alignment with channel 141, controlling the longitudinal movement of locking bar/shackle 22.

When high security, combination padlock 20 of this embodiment is fully assembled, set screw 81 is fully threaded in hole 80, positioned within elongated channel 141. In this position, locking bar/shackle 22 is able to move into and out of locked and unlocked engagement with locking zone 34. However, axial movement of locking bar/shackle 22 beyond the unlocked position is prevented, due to the blocking contact of set screw 81 with walls 142 and 143 of channel 141.

Set screw 81 is typically advanced into threaded hole 80 in order to position set screw 81 in blocking alignment with channel 141 and walls 142 and 143. In this way, axial movement of locking bar/shackle 22 is controlled and limited to its locked and unlocked positions. However, if the user wishes to remove locking bar/shackle 22 from housing/body 21, set screw 81 is withdrawn from its blocking position with channel 141. Once set screw 81 is removed from blocking alignment with channel 141 locking bar/shackle 22 can be manually moved axially and withdrawn from elongated bore 135.

By employing the construction detailed above, slider shaft 24 is continuously urged during normal operation towards locking bar/shackle 22, attempting to cause slider shaft 24 to move into its locked position, with locking post 65 of slider shaft 24 engaged in notch 48 and sloping walls 49 of locking bar/shackle 22. In addition, whenever this locked position is attained, disengagement and unlocking of padlock 20 is achieved by manually moving locking bar/shackle 22 to cause slider shaft 24 to move axially against the forces of spring means 66 to withdraw locking post 65 from engagement in notch 48 and sloping walls 49.

By employing this construction, a user is able to open locking zone 33 by longitudinally moving locking bar/shackle 22 through passageway 34. Once the desired item or items have been positioned in locking zone 33, locking bar/shackle 22 is axially moved towards cavity 35, engaging the item/items to be secured in locking zone 33.

In order to secure the item/items to be locked and place combination padlock 20 in its locked position, locking bar/shackle 22 is advanced into cavity 35 until notch 48 is aligned with locking post 65 of slider shaft 24. Once in this position, slider shaft 24 is forced upwardly into engagement with notch 48 and sidewalls 49 by spring member 60 acting upon slider shaft 24. When all of these components are fully engaged and secured, as shown in FIG. 14, padlock 20 is in the locked position, enabling dials 26 to rotate out of the pre-set combination alignment, thereby placing padlock 20 in its fully locked, high security configuration.

As detailed above, another feature of the present invention, which further assures and enhances the high security, tamper-resistant characteristics of padlock 20, is the unique construction of tumblers/clutch wheels 25 and the interaction of tumblers/clutch wheels 25 with housing/body 21. By referring to FIGS. 4–7, and the detailed discussion provided above, this unique construction and operation is fully understood.

For simplicity, the embodiment of FIGS. 13 and 14 are depicted with a single elongated slot or channel 115 formed in elongated bore 37 and a single locking fin 94 mounted to each tumbler/clutch wheel 25. However, if desired, this embodiment of padlock 20 can be constructed with three fins mounted to each tumbler/clutch wheel 25 and three grooves or channels formed in elongated bore 37, as detailed above. In addition, the remaining detailed discussion provided above for tumbler/clutch wheels 24, rotatable dials, 26, pins 106 and spring 107 has equal applicability to the construction of these components in this embodiment. Consequently, the foregoing detailed disclosure is repeated herein by reference with equal applicability. As detailed above, by employing these elements, the locking and unlocking of this embodiment is achieved with equal efficacy.

One significant difference provided by the construction of the embodiment depicted in FIGS. 13 and 14 is found in the method employed for setting/resetting the combination of the padlock. In this embodiment, the desired combination is changed by employing one of two alternate methods.

In one method, set screw 81 is threadedly withdrawn from threaded hole 80 a sufficient distance to remove the blocking engagement of set screw 81 with elongated channel 140. As a result, locking bar/shackle 22 is able to be axially withdrawn entirely from elongated bore 135.

As is evident from the foregoing detailed discussions, the axial movement of locking bar/shackle 22 can only be achieved after dials 26 have all been placed in the pre-set position representing the desired combination. Once this position has been attained, slider shaft 24 is capable of being axially moved against the spring forces being exerted by spring means 66, allowing locking bar/shackle 22 to be axially withdrawn, while simultaneously causing sloping surfaces 49 of notch 48 to act against the terminating end of locking post 65, causing locking post 65 to be forced downwardly, enabling locking bar/shackle 22 to be moved longitudinally.

Once locking bar/shackle 22 has been completely withdrawn from elongated bore 135, slider shaft 24 will advance upwardly, due to the action of spring means 66. In order to enable the combination to be reset, adjustment tool 145 is inserted through aperture 146 formed in housing 21, in order to controllably move slider shaft 24 downwardly until the terminating end thereof contacts plug 136. Since each locking fin 94 of each tumbler/clutch wheel 25 is moved entirely into release slots/channels 115, whenever combination padlock 20 is in this position, the complete axial movement of slider shaft 24 can be easily achieved by adjustment tool 145.

In addition, whenever slider shaft 24 is axially moved into its combination resetting position, tumbler/clutch wheels 25 are forced to move axially with slider shaft 24, due to the sandwiched engagement of tumbler/clutch wheels 25 between locking washer 71 and enlarged locking post 65. As a result, whenever slider shaft 24 is moved into the combination resetting position, each locking fin 94 of each tumbler/clutch wheel 25 is moved entirely into release slots/channels 115.

In this position, locking fins 94 of tumbler/clutch wheel 25 are completely disengaged from rotatable dials 26. As a result, rotatable dials 26 are capable of being fully rotated about slider shaft 25, completely independently of tumbler clutch wheels 25.

Each dial 26 is arcuately rotated about slider shaft 24 to enable the user to align any desired indicia or numeral appearing on panel 102 of dials 26 to be positioned in alignment with the combination designating line. As a result, by positioning each dial 26 in the precisely desired location, any desired combination can be selected by the user to represent a particular desired combination for opening padlock 20.

Once dials 26 have been arranged in the sequence desired by the user to form the opening combination for padlock 20, slider shaft 24 is released, by withdrawing adjusting tool 145 from hole 146, enabling spring means 66 to cause slider shaft 24 to move axially, returning slider shaft 24 to its fully extended position.

Thereafter, locking bar/shackle 22 is reinserted into elongated bore 135 and advanced into full engagement therein, until slider shaft 24 returns into its locked position, with locking post 65 engaged in notch 48 and sloping walls 49. Once in this position, dials 26 can be rotated out of the combination position, thereby fully engaging and securely locking padlock 20 with a new combination therefor.

In the second, alternate combination resetting method, elongated passageway 147 is formed in locking bar/shackle 22, extending between hole 146 and locking post 65 of slider shaft 24. Using this construction, whenever dials 26 have been placed in the original combination orientation, enabling slider shaft 24 to be freely axially movable, adjusting tool 145 is inserted through hole 146 and passageway 147 until engaging the end of locking post 65. Then, by continuously advancing adjusting tool 145 into engagement with slider shaft 24, slider shaft 24 is forced downwardly, causing the locking fins 94 of tumbler/clutch wheel 25 to be completely disengaged from rotatable dials 26, as a detailed above. Once in this position, any desired combination can be achieved prior to releasing slider shaft 24 for returning to locked engagement with locking bar/shackle 22.

As is evident from the foregoing detailed disclosure, by employing the constructions detailed herein, further uniquely constructed high security, combination padlocks are obtained. Furthermore, these embodiments provide all of the desired functions of a high security combination padlock in a highly effective, easily assembled and easily employed construction, while also being capable of being produced with substantially greater ease and convenience.

It will thus be seen that the objects set forth above, among those made apparent from the preceding description, are efficiently obtained and, since certain changes may be made in the above article without departing from the scope of this invention, it is intended that all matter contained in this disclosure or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention what I claim as new and desire to secure by Letters Patent is:

1. A high security combination padlock constructed for resisting unauthorized persons from opening the padlock, said high security combination padlock comprising:

A. a housing formed from heavy-duty, tamper resistant materials and incorporating a holding and locking zone formed therein;

B. a first elongated bore formed in the housing in cooperating association with a. a plurality of dial receiving zones formed in the housing in juxtaposed, spaced, cooperating relationship with each other, each of said receiving zones
   1. extending substantially perpendicularly to the axis of the first elongated bore, and
   2. defined by two juxtaposed, spaced, parallel facing surfaces, each of said surfaces extending perpendicularly to the central axis of the first elongated bore; and b. at least one elongated release channel formed in the first elongated bore and axially extending therewith, said elongated release channel defining a zone for enabling the axial movement of an axially movable slider shaft;

C. a second elongated bore formed in the housing in cooperating relationship with the holding and locking zone;

D. a first axially movable member forming an elongated locking bar mounted in the second elongated bore and constructed for axial movement therein and positioned for providing locking and unlocking engagement with the holding and locking zone;

E. a second axially movable member forming an elongated slider shaft mounted in said first elongated bore for controlled axial movement therein and cooperating with the locking bar for controlling the axial movement of the the locking bar and the locking/unlocking capabilities thereof;

F. a plurality of tumbler sleeves, each of said tumbler sleeves
   a. being rotationally mounted to the slider shaft for rotational movement about the central axis thereof, and
   b. incorporating at least one radially extending fin formed on the outside surface thereof and constructed for cooperative association with the elongated release channel and the parallel facing surfaces of the dial-receiving zone for preventing the axial movement of the slider shaft as well as enabling axial movement of the slider shaft when each of said radial fins are positioned in the elongated release channel;

G. a plurality of dials, each of said dials
   a. being mounted in a dial receiving zone of the housing,
   b. peripherally surrounding a tumbler sleeve for cooperating there with, and
   c. comprising an inside surface formed by a tumbler locking surface and a tumbler release surface; and H. a locking pin threadedly mounted in the housing for being advanced into the housing in cooperating association with one of said elongated bores in controlled engagement with the axially movable member mounted therein for preventing the axial movable member from being completely removed from said elongated bore for providing blocking engagement of the cooperating axially movable member and for being withdrawn from the housing for enabling the axially movable member to be withdrawn from the elongated bore;

whereby a high security combination padlock is obtained which is quickly and easily assembled with a minimum number of components and provides a highly effective, combination padlock which resists unwanted tampering and effectively blocks unauthorized individuals from gaining access to the padlock.

2. The high security combination padlock defined in claim 1, wherein said slider shaft further comprises a break-away cover mounted to the enlarged knob for being released therefrom in response to excessive force.

3. The high security combination padlock defined in claim 1, wherein the second elongated bore is further defined as comprising two separate and independent passageways, formed on opposite sides of the holding and locking zone with each of said passageways being in juxtaposed, spaced, facing, coaxially aligned relationship with each other, thereby enabling the locking bar to extend from the first passageway, through the holding and locking zone to the second passageway.

4. The high security combination padlock defined in claim 3, wherein at least one of the passageways forming the second elongated bore is further defined as being open at both ends.

5. The high security combination padlock defined in claim 1, wherein said first elongated bore is further defined as being formed in the housing substantially perpendicularly to the second elongated bore for intersecting therewith, and the slider shaft mounted in said first elongated bore is cooperatively associated with spring means for normally biasing the distal end of the slider shaft into contact with the locking bar when mounted in the second elongated bore.

6. The high security combination padlock defined in claim 5, wherein the locking bar incorporates a notch formed in the outer surface thereof in cooperating relationship with the distal end of the slider shaft, and the distal end of the slider shaft is configured for mating engagement in said notch, whereby the biasing engagement of the slider shaft into the locking bar controls the axial movement of said locking bar.

7. The high security combination padlock defined in claim 6, wherein the notch formed in the outer surface of the locking bar incorporates ramped, sloping surfaces which enable axial movement of the locking bar to cause the slider shaft to move against the spring forces for releasing the locking bar whenever the radially extending fins of the tumbler sleeves are all aligned in the elongated release channel.

8. The high security combination padlock defined in claim 7, wherein said locking bar is further defined as comprising an enlarged control knob formed at the terminating end thereof and extending outwardly from said housing for enabling the user to manually control the axial movement of said locking bar.

9. The high security combination padlock defined in claim 6, wherein one end of said locking bar is cooperatively engaged with spring means for continuously biasing said locking bar to move axially, with the engagement of the distal end of the slider shaft in the notch of the locking bar preventing axial movement of the locking bar.

10. The high security combination padlock defined in claim 9, wherein the proximal end of the slider shaft comprises an enlarged knob formed thereon and extending outwardly from the housing for enabling controlled, manual axial movement of the slider shaft against the spring biasing forces, whenever the radially extending fins of the tumbler sleeves are all aligned in the elongated release channel, for releasing the distal end of the slider shaft from the notch of the locking bar and enabling the locking bar to be moved axially into its unlocked position.

11. The high security combination padlock defined in claim 4, wherein one of the passageways forming the second elongated bore is further defined as being closed at one end thereof and incorporates spring means mounted therein for continuously biasing the locking bar to move outwardly therefrom, and said first elongated bore is further defined as being formed in the housing with a longitudinal axis which is substantially parallel to the longitudinal axis of the second elongated bore.

12. The high security combination padlock defined in claim 11, wherein said housing further comprises a third elongated bore formed therein which extends between and interconnects the first elongated bore and the second elongated bore.

13. The high security combination padlock defined in claim 12, and further comprising axially movable locking members mounted in said third elongated bore for cooperating with the locking bar and the slider shaft for controlling the locking and unlocking of the padlock, said axially movable locking members being cooperatively associated with spring means for continuously biasing the locking members into engagement with the locking bar.

14. The high security combination padlock defined in claim 13, wherein said axially movable locking members comprise an elongated, substantially cylindrically shaped rod incorporating a notch formed adjacent its proximal end and a substantially spherical ball mounted adjacent the distal end thereof, and the locking bar is further defined as comprising a substantially continuous groove formed in the outer peripheral surface thereof dimensioned for mating engagement with the spherical ball, thereby controlling the locking and unlocking of the locking bar.

15. The high security combination padlock defined in claim 14, wherein the slider shaft is further defined as comprising a distal end dimensioned for cooperative locking engagement in the notch of the rod and an enlarge knob formed at the proximal end thereof with said knob extending outwardly from the housing for enabling manual movement of the slider shaft, whereby said slider shaft is axially movable whenever the radially extending fins of the tumbler sleeves are all aligned in the release channel and said slider shaft is incapable of axial movement whenever at least one radially extending fin of at least one tumbler sleeve is not positioned in the release channel, thereby causing the distal end of the slider shaft to be fixedly mounted in the notch of the rod, and securing the padlock in locked configuration.

16. The high security combination padlock defined in claim 15, wherein said slider shaft is further defined as comprising a radially extending post mounted therein adjacent the enlarged knob, substantially perpendicular to the longitudinal axis thereof and said post being positioned for cooperative association with the locking pin mounted in the housing for preventing complete axial movement of the slider shaft when said locking pin is fully engaged in the housing and enabling full axial movement of the slider shaft when said locking pin is disengaged from the housing.

17. The high security combination padlock defined in claim 16, wherein said housing further comprises a keyway shaped portal formed therein in cooperating association with the radially extending post for enabling complete axial movement of said slider shaft only when said radially extending post is aligned with the keyway of the portal, and said locking pin is further defined as being positioned directly adjacent the keyway portal for assuring complete control over the axial movement of the slider shaft.

18. The high security combination padlock defined in claim 1, wherein said first elongated bore is further defined as comprising three separate and independent elongated release channels formed therein and axially extending substantially the entire length thereof, and said tumbler sleeves are further defined as comprising three separate and independent radially extending fins formed on the outside surface thereof constructed for cooperative association with the elongated release channels for enabling axial movement of the slider shaft when each radially extending fin of each tumbler sleeve is positioned in an elongated release channel.

19. The high security combination padlock defined in claim 18, wherein the arcuate spacing between the radially extending fins formed on the outside surface of each tumbler sleeve is identical to the arcuate spacing between the elongated release channels formed in the first elongated bore, thereby assuring complete alignment capabilities of said radially extending fins in said release channels for enabling axial movement of the slider shaft when desired.

20. The high security combination padlock defined in claim 19, wherein the arcuate spacing between at least one pair of adjacent radially extending fins and the arcuate spacing between at least one pair of adjacent elongated release channels are dissimilar from the arcuate spacing between the other components, thereby establishing a unique configuration requiring specific positioning of each tumbler sleeve in order to enable the slider shaft to be axially movable.

21. The high security combination padlock defined in claim 20, wherein the arcuate spacing between one pair of adjacent radially extending fins and one pair of adjacent release channels comprises 144° and the arcuate distance between the remaining fins and release channel comprises 108°.

22. The high security combination padlock defined in claim 1, wherein said locking pin is further defined as being threadedly mounted in said housing for being advanced into the housing for controlling the axial movement of the elongated locking bar and for being withdrawn from the housing for enabling the axially movable locking bar to be withdrawn from the elongated bore.

23. The high security combination padlock defined in claim 22, wherein the locking bar further comprises a longitudinally extending channel formed along a portion of the outer surface thereof, and said channel is positioned for cooperating with the locking pin for limiting the axial movement of the locking bar when said pin is engaged with the channel and enabling full axial movement of the locking bar when the pin is withdrawn from the channel.

24. The high security combination padlock defined in claim 1, wherein said elongated slider shaft further comprises a terminating end formed as an enlarged control knob extending outwardly from the housing for enabling manual movement and control of said slider shaft.

* * * * *